US006964104B2

(12) United States Patent
Suzuki et al.

(10) Patent No.: US 6,964,104 B2
(45) Date of Patent: Nov. 15, 2005

(54) TEMPLATE HOLDER

(75) Inventors: Yasuo Suzuki, Itabashi-ku (JP); Yoshimasa Ogawa, Itabashi-ku (JP)

(73) Assignee: Kabushiki Kaisha TOPCON, Tokyo (JP)

( * ) Notice: Subject to any disclaimer, the term of this patent is extended or adjusted under 35 U.S.C. 154(b) by 424 days.

(21) Appl. No.: 10/420,819

(22) Filed: Apr. 23, 2003

(65) Prior Publication Data

US 2003/0182813 A1 Oct. 2, 2003

Related U.S. Application Data

(62) Division of application No. 09/951,516, filed on Sep. 14, 2001, now Pat. No. 6,625,893.

(30) Foreign Application Priority Data

Sep. 14, 2000 (JP) ..... 2000-280164
Sep. 20, 2000 (JP) ..... 2000-285284
Feb. 2, 2001 (JP) ..... 2001-027284

(51) Int. Cl.[7] ..... G01B 5/20
(52) U.S. Cl. ..... 33/200; 33/507
(58) Field of Search ..... 33/200, 28, 507, 33/568, 573, 613, 645, DIG. 21

(56) References Cited

U.S. PATENT DOCUMENTS 3,886,696 A 6/1975 Bruck
4,169,318 A 10/1979 Cortes
5,384,987 A 1/1995 Wiand
6,163,967 A 12/2000 Suzuki et al.
6,237,242 B1 5/2001 Woytassek et al.
6,241,577 B1 6/2001 Shibata
6,263,583 B1 7/2001 Mizuno
6,293,021 B1 9/2001 Freitag et al.
6,425,280 B1 7/2002 Ames et al.
6,427,350 B1 8/2002 Asaoka et al.
6,427,352 B1 8/2002 Pfeiffer et al.

FOREIGN PATENT DOCUMENTS

JP 61-267732 11/1986
JP 3-261814 11/1991
JP 4-93163 3/1992
JP 10-328992 12/1998

*Primary Examiner*—Christopher W. Fulton
*Assistant Examiner*—Amy Cohen
(74) *Attorney, Agent, or Firm*—Oblon, Spivak, McClelland, Maier & Neustadt, P.C.

(57) ABSTRACT

To provide a template holder in which parts such as screws for mounting a template to a template mounting member is not lost. A template holder, in which in a state in which an elastic strut 94 is inserted into a holding hole 81 of a template 80, the template 80 is pressed and is caused to abut upon an end surface 91*b* of a base member 91*a* by the elastic strut 94 by operating a pressing strut 95, whereby while the template 80 is mounted to a holding member 91, the holding member 91 is departed from the template 80 by operating the pressing strut 95 to thereby enable the template 80 to be removed from the elastic strut 94 and the holding member 91, wherein the pressing strut 95 and the elastic strut 94 are held by the holding member 91 when the template 80 is attached and detached.

4 Claims, 15 Drawing Sheets

Fig. 6(a)
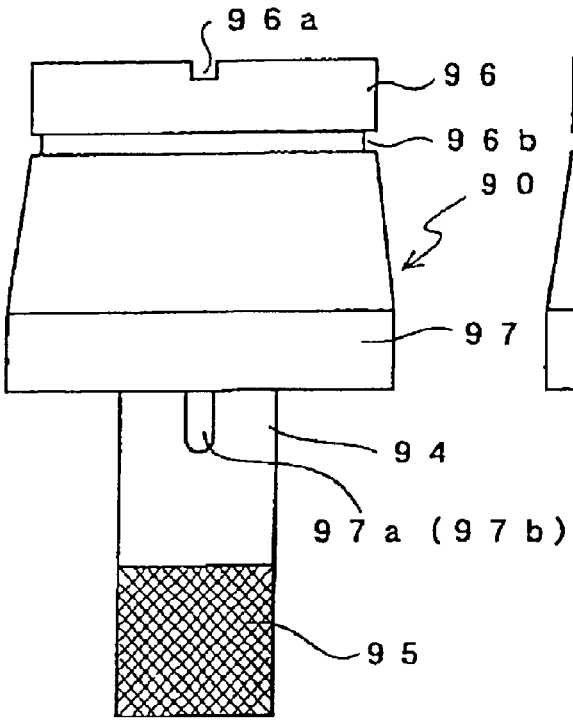
Fig. 6(b)
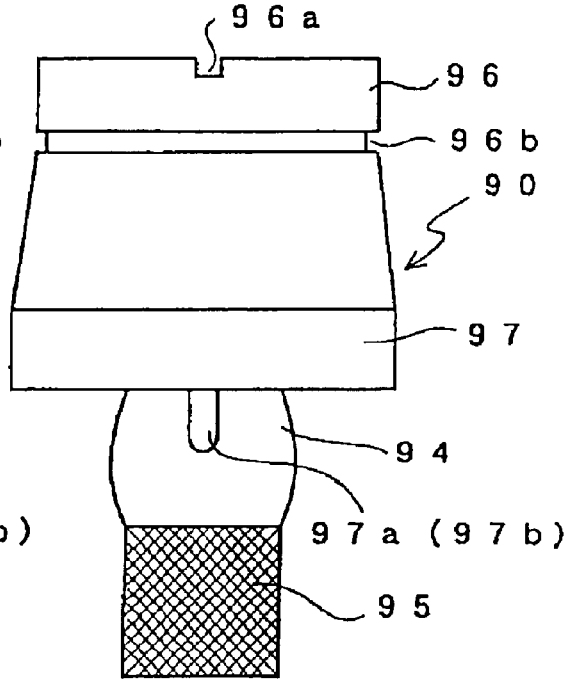
Fig. 6(c)
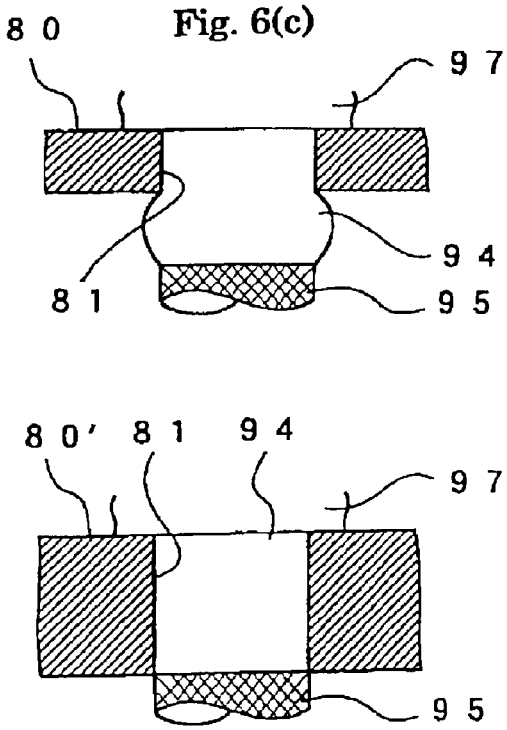
Fig. 6(d)
Fig. 6(e)
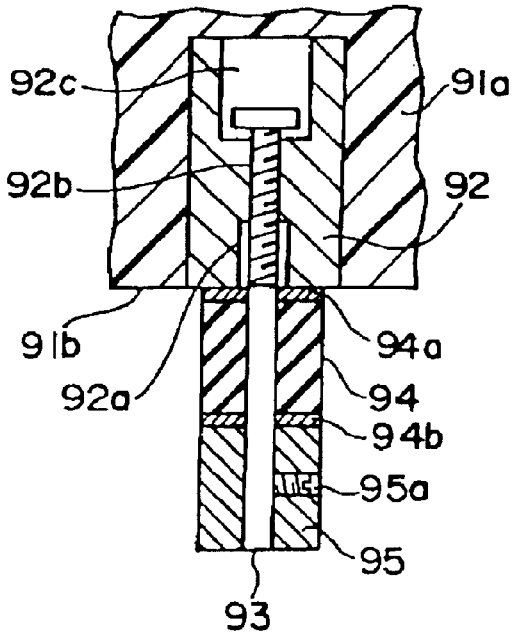

TEMPLATE HOLDER

This application is a division of application Ser. No. 09/951 516, filed on Sep. 14, 2001, now U.S. Pat. No. 6,625,893.

BACKGROUND OF THE INVENTION

1. Field of the Invention

The present invention relates to a template holder for use in measuring the shape of a template obtained by molding after a lens shape of the glasses frame through the use of a lens shape measuring apparatus in order to confirm precision and the like of the lens shape measuring apparatus for a glasses frame.

2. Description of the Prior Art

Conventionally, there has been known a lens shape measuring apparatus for measuring the shape of a glasses frame in a state in which the glasses frame is being pinched in the vertical direction with a clamping pin.

In such a lens shape measuring apparatus, as disclosed in, for example, Japanese Patent Laid-Open Nos. 61-267732, 3-261814, 4-93163, 10-328992 and the like, a template formed after the lens shape of a glasses frame is mounted to a holding member to be secured by screws, and thereafter, the holder main body is mounted to the lens shape measuring apparatus in a state, in which the holding member is caused to be held by the holder main body, to confirm measuring precision and the like of the lens shape measuring apparatus. In this respect, after the confirmation, each of the template, the holding member, the screws and the holder main body is housed in a drawer or the like of the lens shape measuring apparatus.

BRIEF SUMMARY OF THE INVENTION

Object of the Invention

In the above-described lens shape measuring apparatus, however, there has been a problem that since the template has been secured to the holding member (template mounting member) by screws, the fixing operation does not only take a great deal of time, but also particularly small screws will be lost because the holding member and the screws are independently used. In addition, since the holding member and the holder main body are also separately housed, there has been a problem that particularly small holding members will be lost.

A first object according to the present invention is to provide a template holder which does not allow parts such as screws for mounting the template to the template mounting member to be lost in order to solve the above-described problem.

A second object according to the present invention is to provide a template holder capable of facilitating an operation for attaching or detaching the template to or from the template mounting member.

Further, a third object according to the present invention is to provide a template holder capable of preventing the template mounting member from being lost by storing the template mounting member, to which tho template is mounted, together with the holder main body.

SUMMARY OF THE INVENTION

In order to attain the first object, according to the first aspect of the invention, there is provided a template holder comprising: a template mounting member, provided with a holding hole, and provided with a template engaging portion which engages a template formed in the lens shape of a glasses lens for abutting; a holder main body, by which the template mounting member is detachably held, and which is detachably mounted to a lens shape measuring apparatus; a template restraining member, which is movably held by the template mounting member, and which is inserted into the holding hole; and an operating member for moving and operating the template restraining member, in which the template is held by means of the template restraining member by operating the operating member, wherein the operating member and the template restraining member are held by the template mounting member when the template is attached and detached.

In order to attain the above-described second object, according to the second aspect of the invention, there is provided the template holder according to the first aspect, wherein the template restraining member is an elastic strut to be inserted into a holding hole of the template, and the operating member is a pressing strut which causes the elastic strut to abut upon the holding hole under pressure by pressing the elastic strut to enlarge a diameter thereof for thereby moving an outer peripheral surface of the elastic strut to an inner peripheral surface side of the holding hole.

According to the third aspect of the invention, there is provided a template holder according to the second aspect, wherein the pressing strut has a threaded shaft, which penetrates the elastic strut in an axial direction and which is threadably attached to the template mounting member in such a manner as to be freely back-and-forth movable within a predetermined range in the axial direction, and an operating knob, provided at a protruded end portion of the threaded shaft and caused to abut upon the elastic strut.

In order to attain the above-described second object, according to the fourth aspect of the invention, there is provided a template holder according to the first aspect, wherein the template restraining member is a mobile restraining member mounted to the template mounting member in such a manner as to be able to advance toward or retreat from an inner peripheral edge of a holding hole of the template, which is caused to abut upon the template engaging portion, the operating member is a threaded shaft held by the template mounting member in such a manner as to be freely rotatable and unmovable in the axial direction, and the threaded shaft has an axis directed toward the advance or retreat direction of the mobile restraining member, and is threadably attached to the mobile restraining member.

In order to attain the above-described second object, according to the fifth aspect of the invention, there is provided a template holder according to the first aspect, wherein the template restraining member is a mobile restraining member mounted to the template mounting member in such a manner as to be able to advance toward or retreat from the inner peripheral edge of the holding hole of the template, which is caused to abut upon the template engaging portion, and the operating member is held by the template mounting member in such a manner as to be able to freely advance or retreat within a predetermined range in the advance or retreat direction of the mobile restraining member, and is spring-biased toward the inner peripheral edge of the template by a spring.

In order to attain the above-described third object, according to the sixth aspect of the invention, there is provided a template holder according to any one of the first to fifth aspects, wherein the holder main body integrally has a housing portion for housing the template mounting member.

BRIEF DESCRIPTION OF THE DRAWINGS

FIG. 6(*a*) is a side view the holding member of FIG. 5, FIG. 6(*b*) is a side view when the elastic strut of FIG. 6(*a*) has been deformed by compression, FIGS. 6(*d*) and 6(*e*) are cross-sectional views for explaining an operation of the elastic strut when plate thickness (thickness) of the template is made different, and FIG. 6(*e*) is a cross-sectional view showing a mounting portion of the elastic strut of the holding member.

DETAILED DESCRIPTION OF THE PREFERRED EMBODIMENTS

[First Embodiment]

[Constitution]

Hereinafter, with reference to the drawings, the description will be made of a template holder according to an embodiment of the present invention.

Figure 1:
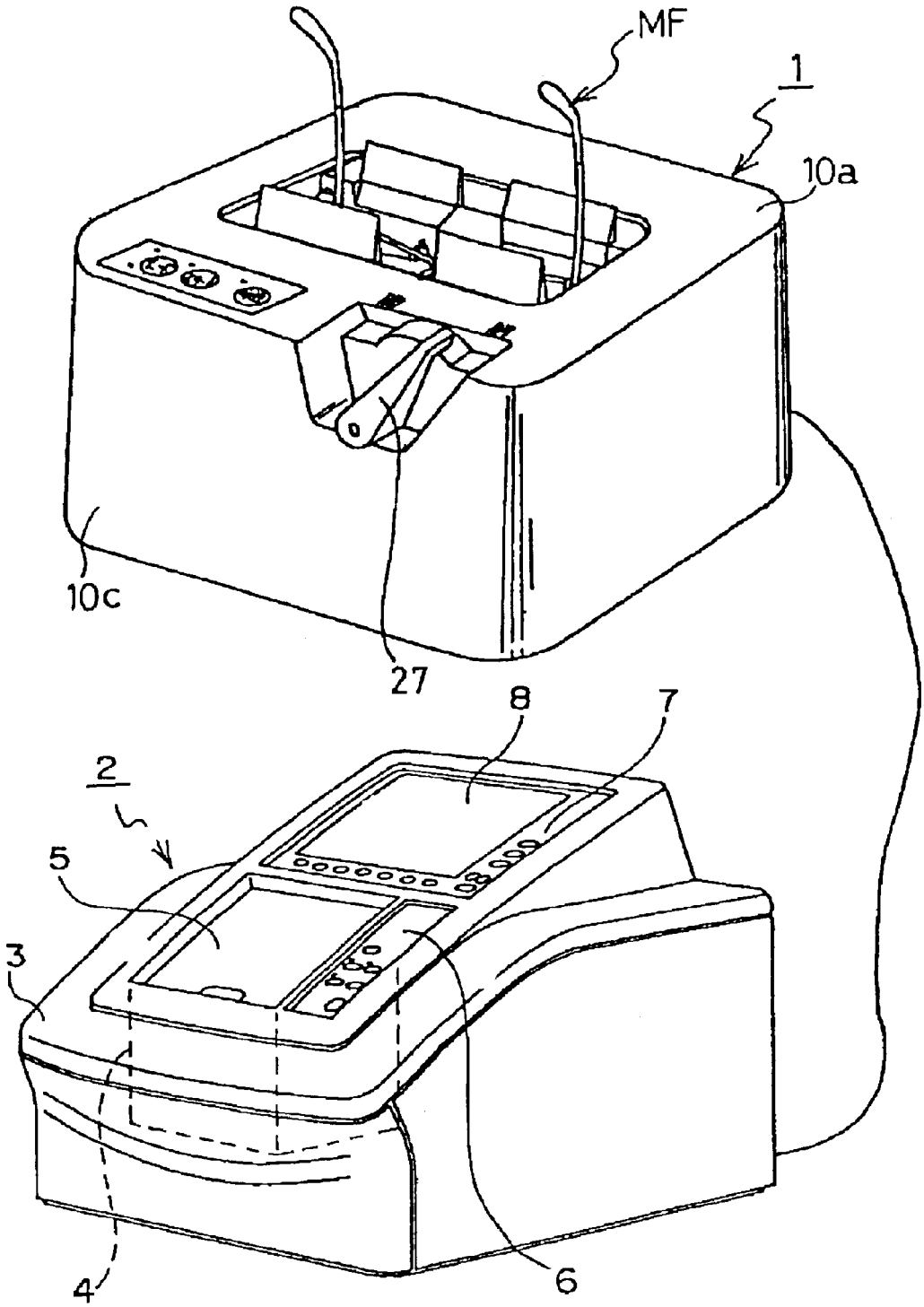
FIG. 1 is an explanatory view illustrating relationship between the lens shape measuring apparatus for glasses frame and a lens grinding machine.

In FIG. 1, reference numeral 1 denotes a frame shape measuring apparatus as a lens shape measuring apparatus; and 2, a lens grinding for grinding a lens to be worked in a shape of the glasses lens on the basis of shape data on the glasses frame from the frame shape measuring apparatus 1.

Figure 2:
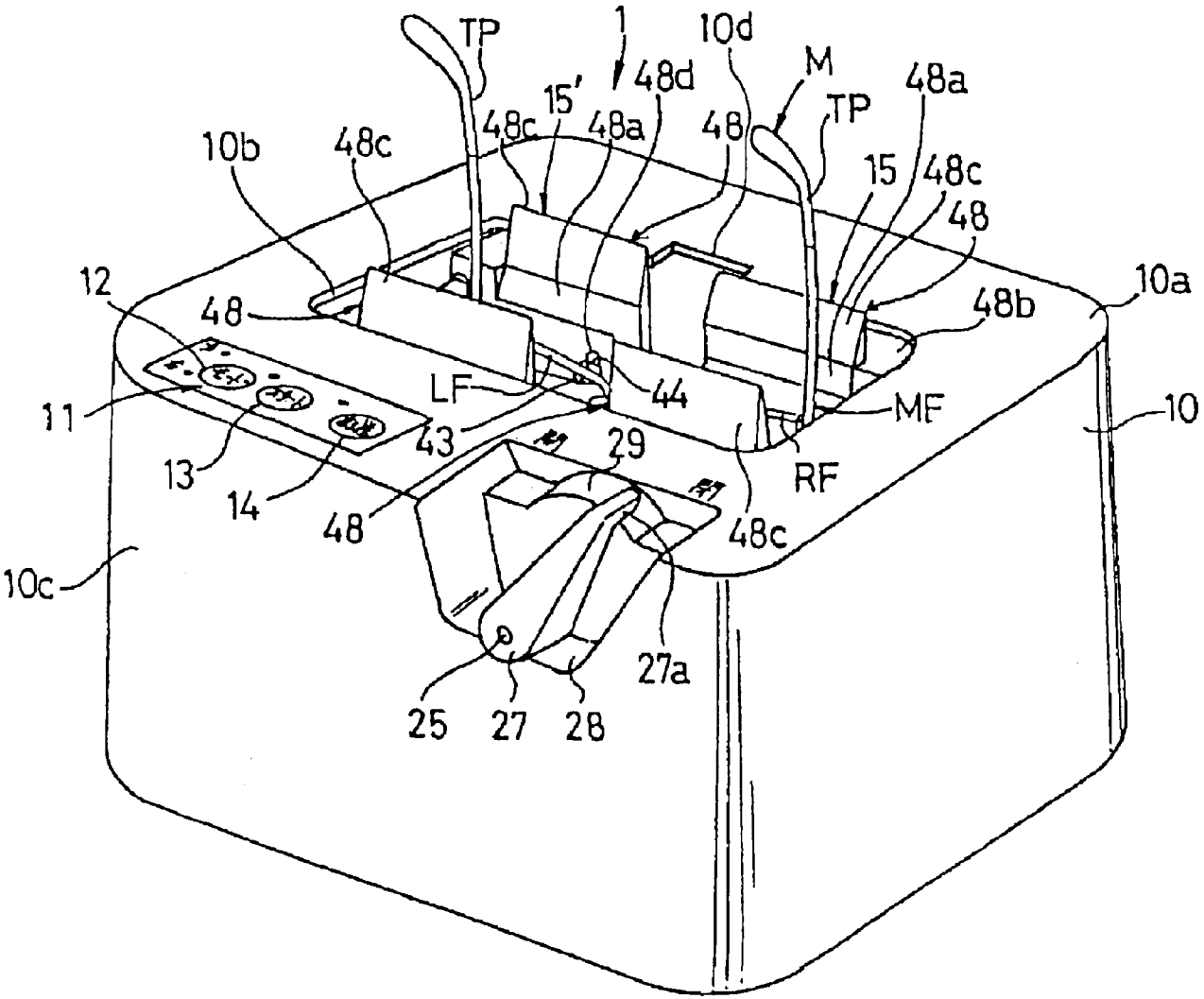
FIG. 2 is an enlarged perspective view showing the lens shape measuring apparatus.

The fame shape measuring apparatus 1 has, as shown in FIG. 2, a main body 10 of measuring apparatus having an aperture 10*b* at the center of the upper surface 10*a*, and a switch portion 11 provided on the upper surface 10*a*. This switch portion 11 has a mode selector switch 12 for switching right and left measuring modes, a start switch 13 for starting the measurement, and a transfer switch 14 for transferring data.

Figures 3A, 3B, 3C, 3D:
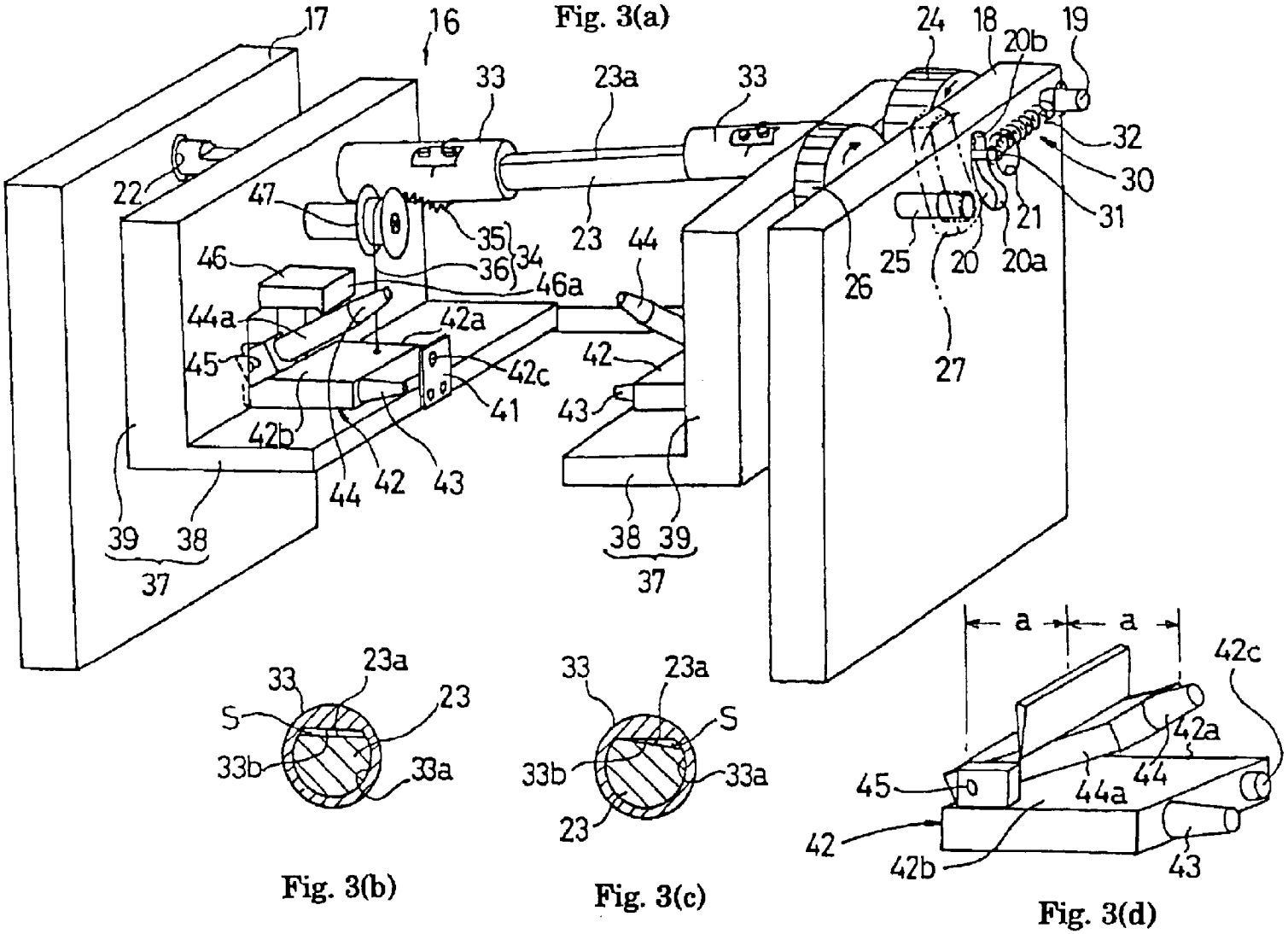
FIG. 3(*a*) is an essential explanatory view illustrating the lens shape measuring apparatus, FIGS. 3(*b*) and 3(*c*) are cross-sectional views for explaining relationship between a tubular shaft and the operating shaft of FIG. 3(*a*), and FIG. 3(*d*) is an explanatory view illustrating a holding pawl.

The frame shape measuring apparatus 1 has glasses frame holding mechanisms 15 and 15' holding right and left lens frames LF and RF of a glasses frame MF, and its operating mechanism 16. In this respect, since the frame holding mechanisms 15 and 15' have the same structure, the description will be made of only one frame holding mechanism 15 as shown in FIG. 3. In this respect, in FIG. 3, reference numerals 17 and 18 denote supporting frames vertically fixed and provided in parallel with each other to a chassis (not shown) within the main body 10 of measuring apparatus; 19, a restraining pin protruded on the outer surface (surface at a side opposite to the supporting frame 17) of a supporting frame 18; 20, a circular arc-shaped slit provided at the upper end portion of the supporting frame 18; 21 or 22, a mounting hole provided on the supporting frame 17 or 18. The mounting holes 21, 22 is interposed between the circular arc-shaped slit 20 and the restraining pin 19, and the circular arc-shaped slit 20 is provided coaxially to the mounting holes 21, 22.

(Operating Mechanism 16)

The operating mechanism 16 has an operating shaft 23 rotatably held by the mounting holes 21, 22 of the supporting frame 17, 18; a driven gear 24 fixed to one end portion (end portion on the supporting frame 18 side) of the operating shaft 23; a rotating shaft 25 for penetrating the supporting fame 18 and the front surface 10*c* of the main body 10 of measuring apparatus; a driving gear 26 fixed (or integrally provided) at one end portion of the rotating shaft 25 for meshing with the driven gear 24; and an operating lever 27 mounted to the other end portion of the rotating shaft 25. In the figure, reference numeral 23*a* denotes a flat portion provided on the operating shaft 23, and this flat portion 23*a* is provided to the vicinity of both end portions of the operating shaft 23.

In this respect, the main body 10 of measuring apparatus is formed with a concave portion 28 lying aside the upper surface 10*a* and the front 10*c*, on the upper surface of this concave portion 28, there is formed a circular arc-shaped protruded portion 29, and the upper surface 10*a* is attached with "Open" and "Close" at the left and right of the protruded portion 29 respectively. Thus, on the front of the concave portion 28, there is displaced the above-described operating lever 27, and a bent portion provided at the top end portion of the operating lever 27, that is, an indicating portion 27*a* is adapted to move on the protruded portion 29.

Also between the driven gear 24 and the restraining pin 19, there is provided a two-position holding mechanism (two-position holding means) 30 for causing frame holding (corresponds to the above-described "Close") and releasing the frame holding (corresponds to the above-described "Open").

This two position holding mechanism 30 has the circular arc-shaped slit 20, a movable pin 31 projectingly provided on the side of the driven gear 24 for penetrating the circular arc-shaped slit 20, and a spring (extension coil spring) 32 interposed between the movable pin 31 and the restraining pin 19. Since this circular arc-shaped slit 20 is concentric with the mounting holes 21, 22 as described above, both the driven gear 24 and the operating shaft 23 are also concentric with each other. For this reason, the movable pin 31 is held by either of both end portions 20*a* and 20*b* of the circular arc-shaped slit 20 by means of the tensile strength of the spring 32.

Further, the operating mechanism 16 has a pair of tubular shafts 33 and 33 held by the operating shaft 23 in such a manner as to be movable in the longitudinal direction and to be slightly relatively rotatable circumferentially. Between a flat portion 33*b* of a cut circle-shaped insertion hole 33*a* within this tubular shaft 33 and a flat portion 23*a* of the operating shaft 23, there is formed a slight clearance S as shown in FIGS. 3(*b*) and 3(*c*). To the tubular shafts 33 and 33, there is attached a string-shaped body 34 (only one is shown in FIG. 3(*a*)) having an elastic portion capable of expansion and contraction by means of its own elastic force respectively. This string-shaped body 34 has a spring 35, one end portion of which is fixed to the tubular shaft 33, and a wire 36 provided contiguously to the other end portion of the spring 35.

(Frame Holding Mechanism 15, 15')

The frame holding mechanism 15 has a pair of movable frames 37 and 37 held within the main body 10 of measuring apparatus in such a manner as to be movable in the horizontal direction, and to be movable toward and away from each other. Each of these movable frames 37 is formed of a horizontal plate portion 38 and a vertical plate portion 39 provided vertically, contiguously to one end portion of the horizontal plate portion 38 in a substantially L-character shape. On the vertical plate portion 39, there is held the tubular shaft 33 by the vertical plate portion 39 in such a manner as to be freely rotatable and be unmovable in the axial direction.

Figure 4A:
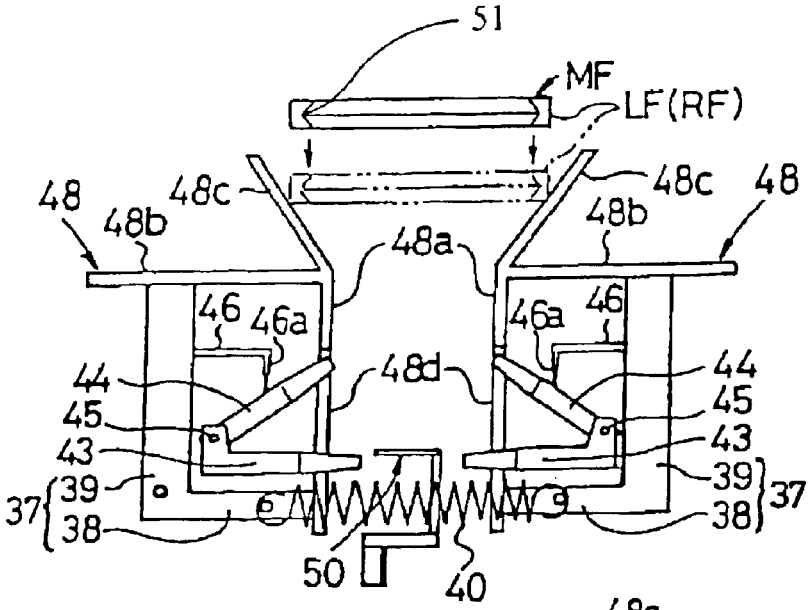
FIGS. 4(*a*) to 4(*c*) are operation explanatory views for glasses frame holding of the lens shape measuring apparatus shown in FIG. 3.
Figure 4B:
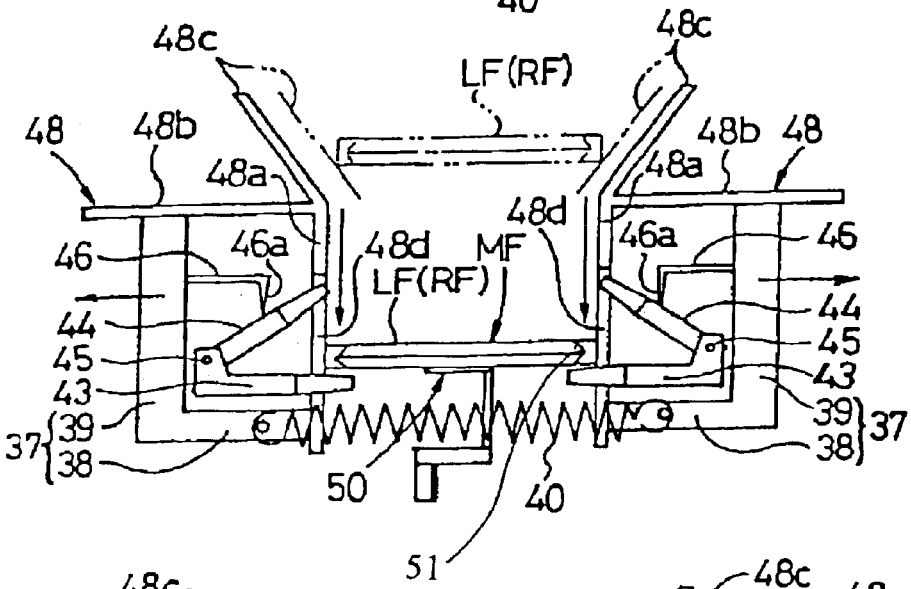
Figure 4C:
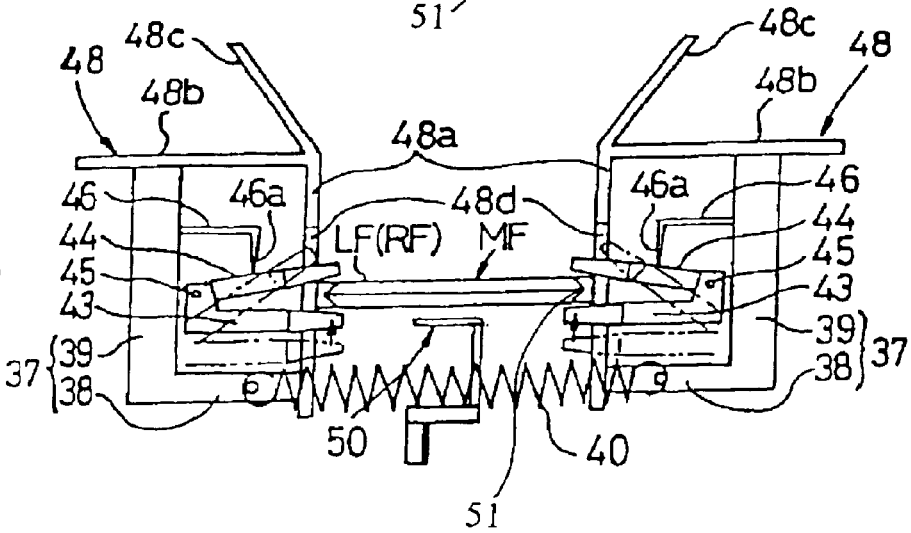

Also, the frame holding mechanism 15 has, as shown in FIG. 4, an extension coil spring 40 interposed between the horizontal plate portions 38 and 38, a supporting plate 41 fixed at the center of the tip end edge portion of the horizontal plate portion 38, and a pawl mounting plate 42 disposed between a portion protruding above the horizontal plate portion 38 and the vertical plate portion 39. This pawl mounting plate 42 is held by the supporting plate 41 and the vertical plate portion 39 so as to be able to rotate around a shaft-shaped supporting protruded portion 42*c* of one side portion 42*a*. In this respect, the illustration of a shaft-shaped supporting protruded portion of the pawl mounting plate 42 on the rear portion side is omitted.

At the tip end of the other side portion 42*b* of the pawl mount plate 42, a shaft-shaped, tapered holding pawl 43 is projectingly provided as a first clamping pin, and at the rear end portion of the other side portion 42*b* of the pawl mounting plate 42, the rear end portion of a shaft-shaped holding pawl 44 as a second clamping pin is rotatably held by the supporting shaft 45. This holding pawl 44 has a proximal portion 44*a* formed in a rectangular plate shape (See FIG. 3(*d*)) and a tip end portion formed in a tapered shape, and rotates around the supporting shaft 45 in such a manner as to be movable toward and away from the holding pawl 43. Moreover, the tip end portion of the holding pawl 44 and the pawl mounting plate 42 are always spring-biased by a torsion spring (not shown) wound around the supporting 45 in a direction that opens.

Further, on the plate portion 39, there is projectingly provided a L-shaped engaging pawl 46 which is located above the holding pawl 44 and cooperates with the operating mechanism 16. An edge-shaped pawl portion 46*a*, which extends below the tip end portion of the engaging pawl 46, is engaged with the holding pawl 44. Thereby, when the other side portion 42*b* of the pawl holding plate 42 is rotated upwardly about one side portion 42*a*, the interval between the holding pawls 43 and 44 is adapted to be narrowed against the spring force of the torsion spring.

In this respect, as shown in FIG. 3(*d*), the edge-shaped pawl portion 46*a* of the engaging pawl 46 engages the substantially central portion of the holding pawl 44. Also, between the engaging pawl 46 and the tubular shaft 33, there is disposed an idle pulley 47 rotatably held by the vertical plate portion 39. On this idle pulley 47, there is supported the above-described wire 36, and the end portion of the wire 36 is located at substantially center between both side portions 42*a* and 42*b*, and is fixed to the pawl mounting plate 42.

The opposite portion side of each of the movable frames 37 and 37 is covered with a frame guide member 48. This frame guide member 48 has a vertical plate portion 48*a* fixed at the tip end of the horizontal plate portion 38, a horizontal plate portion 48*b* fixed at the top end of the vertical plate portion 39, and an inclined guide plate portion 48*c* which is provided contiguously to a corner, where plate portions 48*a* and 48*b* are provided contiguously to each other, and which inclines toward the horizontal plate portion 48*b* side. On the vertical plate portion 48*a*, there is formed an aperture 48*d* correspondingly to the holding pawls 43 and 44, and the holding pawl 44 is caused to protrude from the aperture 48*d*. Also, the tip end portion of the holding pawl 43 is adapted to be located within the aperture 48*d* in a state (See FIGS. 4(*a*) and 4(*b*)) in which the holding pawls 44 and 43 are opened at maximum.

In this respect, the vertical plate portion 48*a*, 48*a* of the frame guide member 48, 48 provided for each movable frame 37, 37 has a surface provided in parallel to each other and opposite to each other as a holding surface. These pair of holding surfaces of the vertical plate portions 48*a* and 48*a* are brought toward and away from each other as the movable frames 37 and 37 move toward and away from each other.

The frame shape measuring apparatus (lens shape measuring apparatus) 1 has shape measuring means of measuring the shape of a rim of a glasses frame MF of glasses, that is, a lens frame LF (RF) of a glasses frame MF. By causing a feeler 50 to move along a V-groove 51 of the glasses frame F, this shape measuring means is adapted to be able to determine a moving position of the feeler 50 as a radius vector $\rho i$ to an angle $\theta i$, that is, as lens shape information ($\theta i$, $\rho i$) of polar coordinates type. Since a well-known structure can be adapted for this structure, its detailed description will be omitted.

Figure 10A:
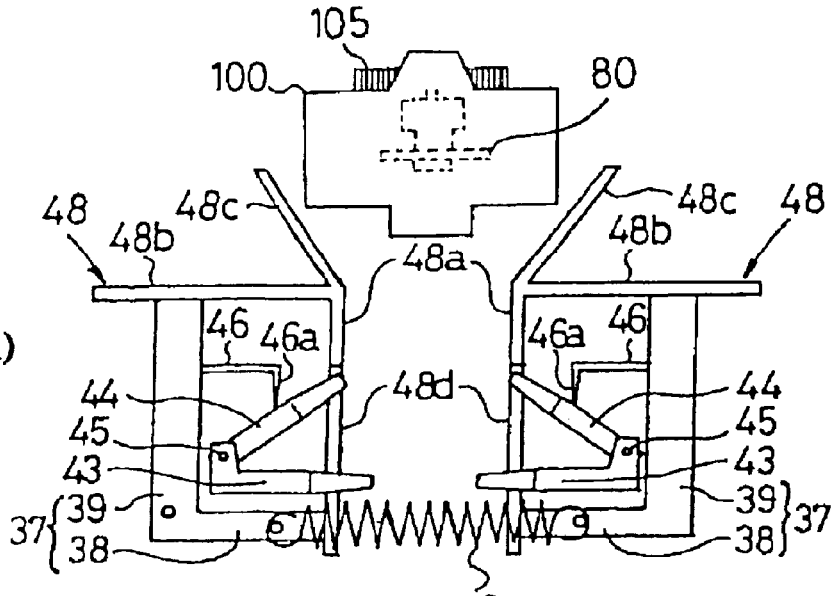
FIGS. 10(*a*) to 10(*c*) are operation explanatory views when the lens shape of a template is measured by means of the frame shape measuring apparatus shown in FIG. 2 through the use of the holder main body shown in FIG. 7.
Figure 10B:
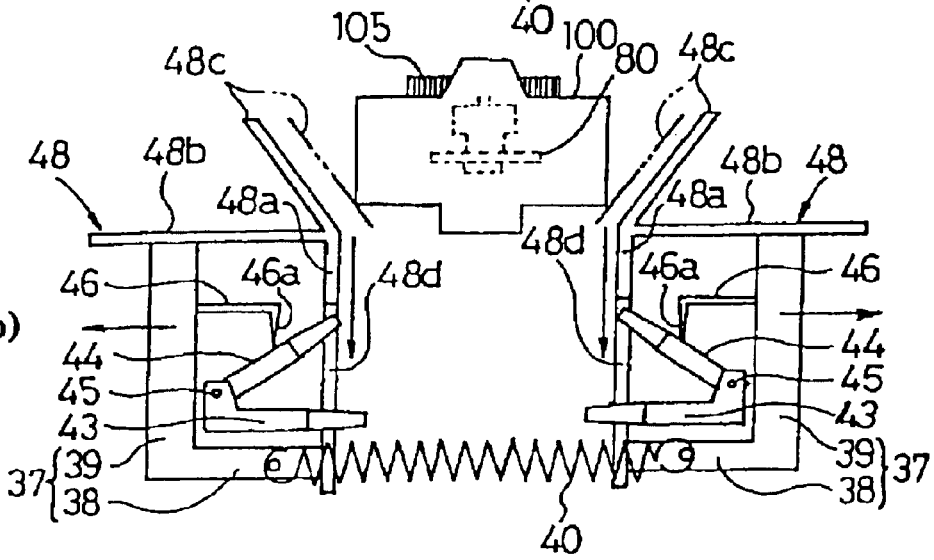
Figure 10C:
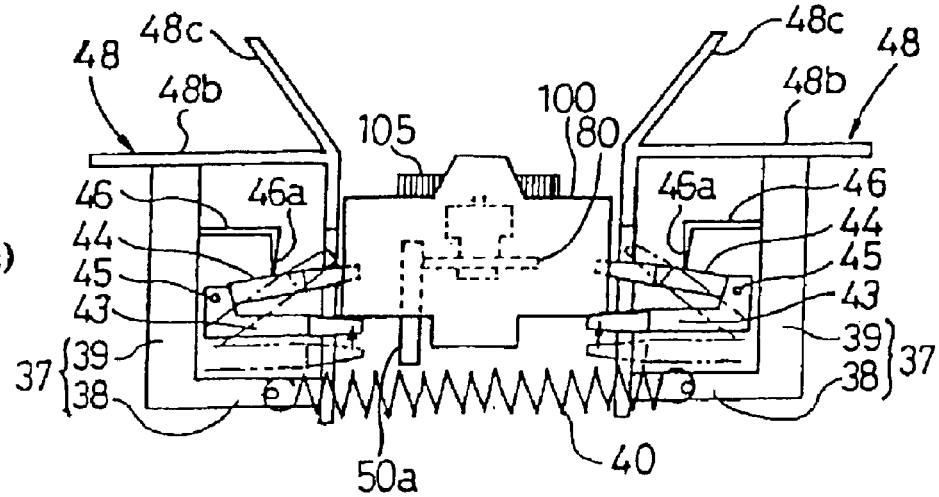

Also, the frame shape measuring apparatus 1 has a semi-cylindrical feeler 50*a* (see FIG. 10(*c*)) for measuring the shape of a template, a model lens and the like. This feeler 50*a* can be replaced with the feeler 50 for use. For this feeler 50*a*, the feeler 50 and its switching mechanism, well-known ones disclosed in the previous application of the applicant of the present application can be adopted, and therefore, the detailed description will be omitted.

Further, the lens grinding machine 2 has, as shown in FIG. 2, a machining unit 60 (detailed illumination omitted) for grinding the peripheral edge of the lens to be worked. This machining unit 60 is caused to hold the lens to be worked between a pair of lens rotating shafts of a carriage, and the rotation of these lens rotating shafts and up-and-down rotation of the carriage is controlled on the basis of the lens shape information ($\theta i$, $\rho i$), and the peripheral edge of the lens to be worked is ground by a rotating grinding stone.

Since this structure is well-known, its detailed description will be omitted.

<Template Holder>

Figure 5:
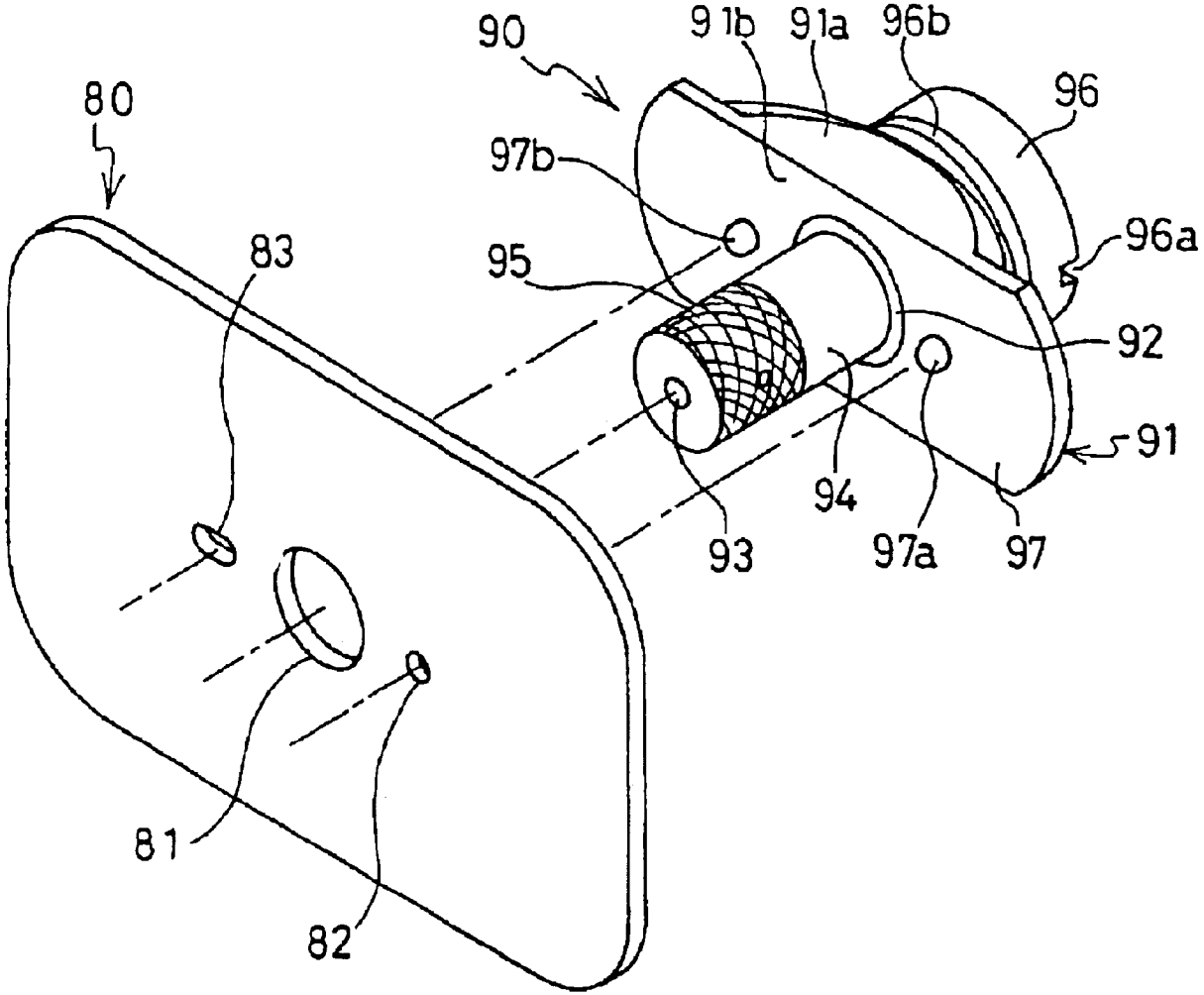
FIG. 5 is an exploded perspective view showing relationship between the holding member an the template.
Figure 7:
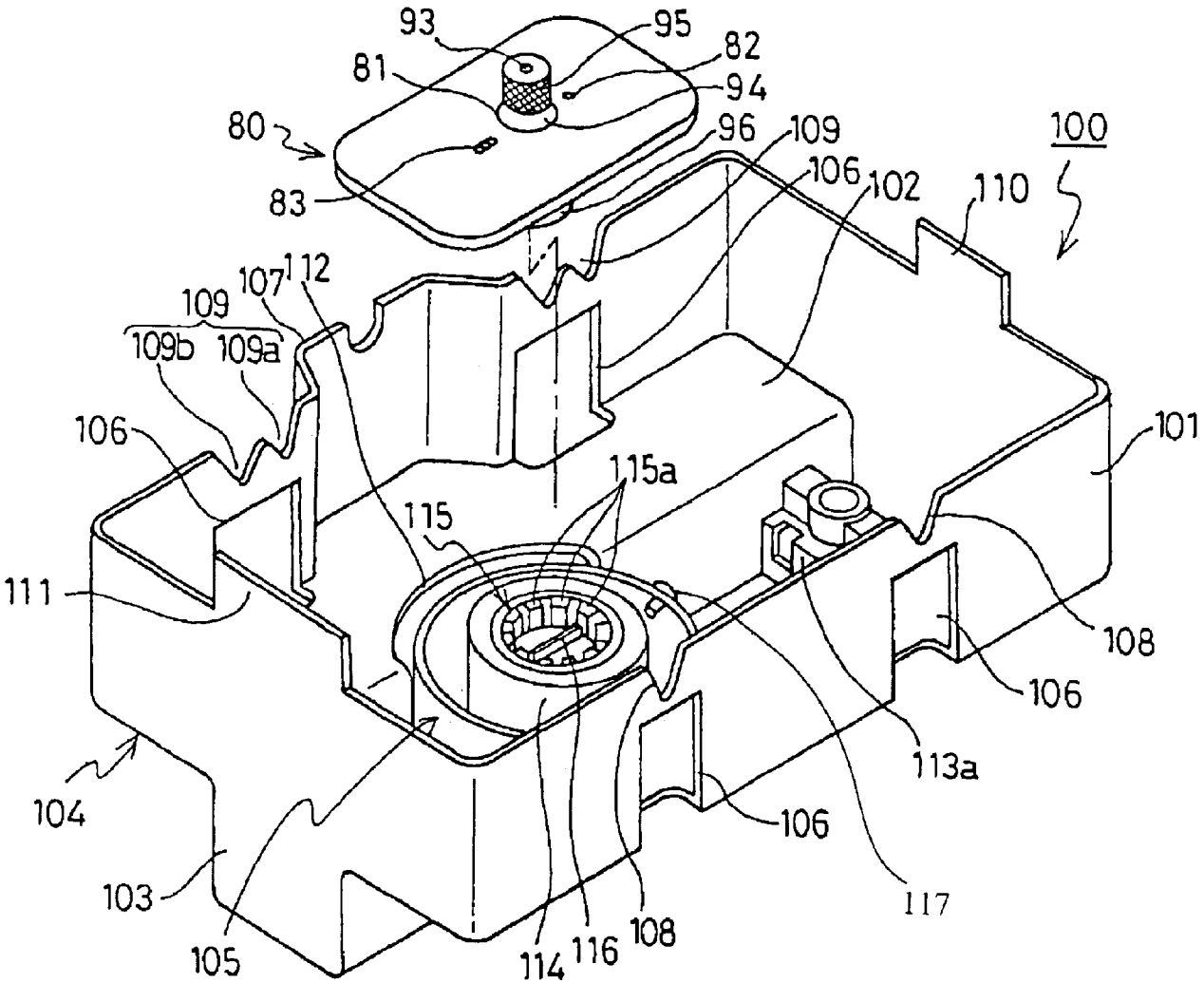
FIG. 7 is a perspective view showing the base surface side of the holder main body.

In FIG. 5, reference numeral 80 denotes a template formed in a lens shape such as shape of the lens frame of the glasses, shape of the glasses lens or the like. The shape of this template 80 can be measured by the frame shape measuring apparatus 1 through the use of the template holder A shown in FIG. 8. In this respect, circumference of the template 80 having predetermined circumference (for example, 162.83 mm) is measured, whereby the precision or the like of the template 80 can be confirmed.

This template holder A has a holding member 90 (template mounting member), to which the template 80 is mounted, and the holder main body 100 (See FIG. 10) by which the holding member 90 is held.

This template 80 has a holding hole (through hole) 81 for inserting into the shaft formed at its center, a positioning small hole 82 and an adjusting slot 83 which are formed in a position in which the holding hole 81 is sandwiched.

When mounting the template 80 to the holding member (template mounting member) 90, even if there may be variations due to molding and machining in a dimension between holes 82 and 83 of the template 80 and a dimension between projections 97*a* and 97*b* to be described later of the holding member 90, this adjusting slot 83 is adapted to allow the error due to these variations in dimension.

The holding member 90 as the template mounting means has a base portion 91 made of resin to be held by the holder main body 100. This base portion 91 is obtained by integrally forming a main body 91*a* of base being circular arc-shaped in side shape and rectangular in plane shape; a cylindrical column-shaped portion 96 provided at the center of the circular arc-shaped outer surface of the main body 91*a* of base; and flange portions 97 and 97 protruded from both ends of the flat end surface 91*b* in the longitudinal direction at a side opposite to the cylindrical column-shaped portion 96 of this main body 91*a* of base.

An end surface 91*b* of this base portion 91 on the flange 97 side becomes the template engaging portion. Moreover, on an end surface of the cylindrical column-shaped portion 96, there is formed a positioning groove 96*a*, which extends in the same direction as a protruding direction of the flange portion 97. Also, on the outer periphery of the cylindrical column-shaped portion 96, there is formed an annular restraining groove 96*b*. Further, on one flange portion 97, there is projectingly provided a projection 97*a* having the substantially same diameter as the inner diameter of the positioning small hole 82, while on the other flange 97, there is projectingly provided a projection 97*b* for engaging the adjusting slot 83.

Also, the holding member 90 has a shaft-shaped or tubular bearing fixture (shaft mounting member) 92 buried in the main body 91*a* of base of the base portion 91 as shown in FIG. 6(*e*). In this bearing fixture 92, there are formed a small-diameter hole 92*a*, a threaded hole 92*b* and a large-diameter hole 92*c* in order from the outside as shown in FIG. 6(*e*).

Also, the holding member 90 has a shaft 93, as an operating member, held by the bearing fixture 92 so as to be able to rotate by a predetermined number of revolutions. In other words, the shaft 93 has a threaded portion 93*a* threadably attached to the threaded hole 92*b*, and a head 93*b* integrally provided on a protruded end portion into the large-diameter hole 92*c* of the threaded portion 93*a*. With this configuration, when it is rotated in the forward or reverse direction, the shaft 93 is capable of advancing and retreating within a predetermined range in the axial direction by the operation of the threaded portion 93*a*. In this respect, each of the above-described projections 97*a*, 97*b* is actually the same, and is provided in symmetrical positions with respect to the shaft 93 and in parallel to the shaft 93.

Further, the holding member 90 has an elastic strut 94 inserted on the proximal portion side of a portion for protruding from the bearing fixture 92 of the shaft 93, and a pressing strut (operating knob) 95 attached to the tip end side of the shaft 93. This elastic strut (elastic tubular body) 94 is formed of a deformable elastic body (elastic material) such as rubber as a template restraining member, and a pressing strut 95 is fixed to the shaft 93 by screws 95*a*. In this respect, reference numeral 94*a* denotes a washer interposed between the end surface of the bearing fixture 92 and the elastic strut 94; and 94*b*, a washer interposed between the elastic strut 94 and the pressing strut 95. These washers 94*a* and 94*b* are fixed to both end portions of the elastic strut 94 by baking to improve the operability. Also, the washers 94*a* and 94*b* are formed of slippery bearing material or the like, whereby the frictional resistance when rotating the shaft 93 is reduced to improve the rotational operability of the shaft 93. In addition, on rotating the shaft 93, the elastic strut 94 is prevented from being worn.

When by taking the pressing strut 95, which is an operating knob, with fingers to rotate the shaft 93, the shaft 93 is buried by the operation of the threaded portion 93*a*, the pressing strut 95 approaches the flange portion 97 side, the elastic strut 94 is pressed by the pressing strut 95, and this pressure causes the elastic strut 94 to become deformed in a substantially barrel shape as shown in FIG. 6(*b*).

Moreover, in the case where the template 80 is smaller than the length of the elastic strut 94 and is thin-wall as shown in FIG. 6(*c*), when the elastic strut 94, which does not become deformed into the barrel shape as shown in FIG. 6(*a*), is inserted into the holding hole 81 of the template 80, each projection 97*a*, 97*b* is caused to engage with each hole 82, 83, and the template 80 is brought into tight contact with the surface (template engaging portion) 91*b* on the flange 97 side, a portion of the elastic strut 94 protrudes from the holding hole 81. In this state, the pressing strut 95 is rotated to thereby rotate the shaft 93, and the pressing strut 95 is caused to make a displacement on the side of the main body 91*a* of base by the operation of the screw 93*a*, whereby a portion for protruding from the holding hole 81 of the elastic strut 94 becomes elastically deformed into a barrel shape as shown in FIG. 6(*c*) to have a larger diameter. The portion for protruding from the holding hole 81 of the elastic strut 94 is caused to become deformed into the barrel shape, whereby the outer peripheral surface of the portion for protruding from the holding hole 81 of the elastic strut 94 is caused to move and make a displacement to the inner peripheral edge side of the holding hole 81 of the template 80, to abut upon the holding hole 81 under pressure and the template 80 is mounted (is held) to the holding member 90.

In this respect, in the case where the template 80 has thickness substantially equal to or larger than the length of the elastic strut 94 as shown in FIG. 6(*d*), the pressing strut 95 is rotated to thereby rotate the shaft 93, and the pressing strut 95 is caused to make a displacement to the side of the main body 91*a* of base by the operation of the screw 93*a*, whereby the elastic strut 94 is going to become elastically deformed into the barrel shape to have larger diameter within the holding hole 81 as shown in FIG. 6(*b*). Thereby, the outer peripheral surface of the elastic strut 94 moves and makes a displacement to the inner peripheral surface side of the holding hole 81, abuts upon the inner peripheral surface (inner peripheral edge) of the holding hole 81 under pressure and the template 80 is mounted (is held) to the holding member 90.

As described above, the template 80 can be easily mounted to the holding member 90 irrespective of the thickness of the template 80. Moreover, since the elastic strut 94 is capable of freely changing its own shape whether the thickness of the template 80 is large or small, it is possible to hold the template 80 to the holding member 90 with a fixed holding force.

On the other hand, by reversing this procedure, it is possible to remove the template 80 from the holding member 90.

Also, since the base portion 91, the bearing fixture 92, the shaft 93, the elastic strut 94, and the pressing strut 95 are integrally assembled, each of these will not be disconnected. Moreover, the pressing strut 95 thus made integral is merely rotated, whereby it is possible to become deformed into the barrel shape, and to return to the cylindrical column shape, and to attach, to detach and to fix the template 80 easily and reliably. On attaching and detaching the template 80, since the bearing fixture 92, the shaft 93, the elastic strut 94 and the pressing strut 95 will not be removed from the base portion 91, there is no possibility that parts such as the bearing fixture 92, the shaft 93, the elastic strut 94 and the pressing strut 95 will be lost.

Figure 8:
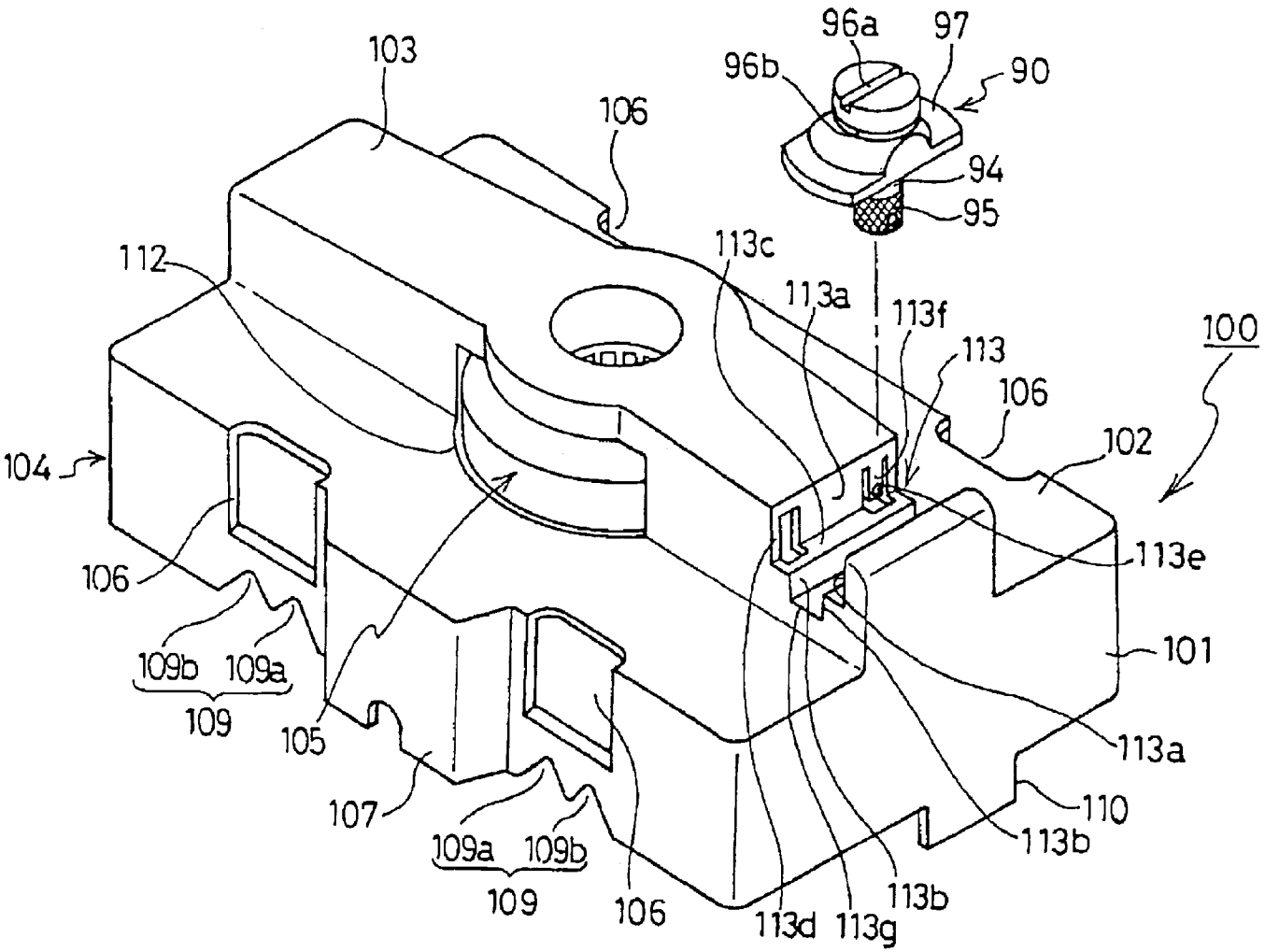
FIG. 8 is a perspective view showing the flat surface side of the holder main body.

The holder main body 100 has, as shown in FIGS. 10 and 8, a main body portion 104 in which a rib-shaped knob portion 103 formed to be long and narrow in the longitudinal direction on the top wall 102 of a rectangular frame 101 is integrally formed, and a substantially cylindrical fixed knob 105 rotatably held at the center of the knob portion 103.

On a wall surface extending in the longitudinal direction of the rectangular fame 101, there is formed an insertion hole 106, into which a holding pawl 44 to be described later is to be inserted. Also, at the center of one wall surface extending in the longitudinal direction, there is formed a bulge-protruded portion 107 for positioning, which protrudes outwardly, between the insertion holes 106 and 106.

The bulge-protruded portion 107 is adapted to determine the orientation of installation of the holder main body 100 by engaging it with a cutout 10*d* formed on the upper surface 10*a*. The cutout 10*d* is opened for the aperture 10*b*, and is provided correspondingly to between the frame guide members 48 and 48 provided side by side.

Also, on the aperture edge portion of the rectangular frame 101, there are formed V-shaped cutouts 108 and 108, each of which is enlargedly opened on the aperture edge portion side correspondingly to the insertion hole 106, 106, and W-shaped cutouts 109 and 109.

A cutout 109*a* inside (near the bulge-protruded portion 107) this W-shaped cutout 109 opposes to the cutout 108, is adapted to be held by a clamping pin of the old type frame shape measuring apparatus 1, and an outside cutout 109*b* of the W-shaped cutout 109 is adapted to be engaged with the clamping pin of the new type frame shape measuring apparatus 1.

Also, on the wall surface which extends in the traverse direction of the rectangular frame 101, there are formed pawl pieces 110 and 111 projecting from the aperture edge portion.

At the center of the upper wall 102, there is formed an aperture 112 which lies astride the knob portion 103 and is exposed to allow the rotation of a fixed knob 105.

Figure 9:
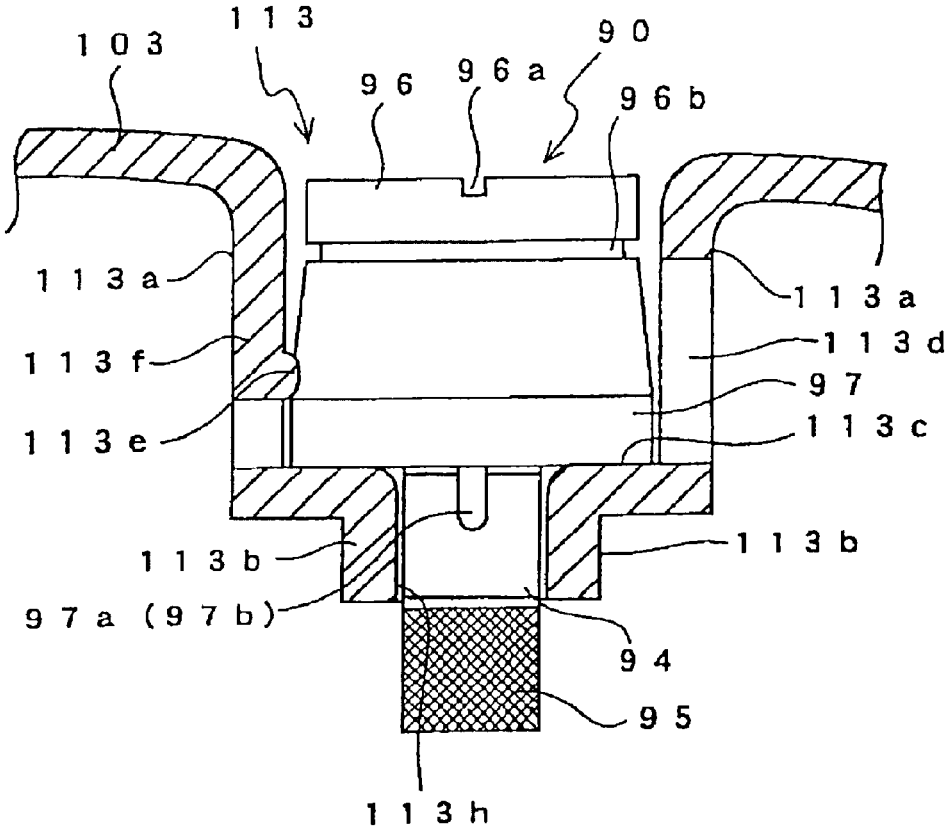
FIG. 9 is an essential enlarged cross-sectional view showing a state in which the holding member is housed in the holder main body.

Near one side of the knob portion 103, there is formed a housing recess 113 for the holding member 90. This housing recess 113 has, as shown in FIG. 9, holding walls 113*a*, which are opposite to each other, and an opposite width of which is substantially same as the width of the flange 97 in the transverse direction; housing walls 113*b*, which are opposite to each other, and the opposite width of which is substantially equal to or larger than the diameter of each strut 94, 95; and a stepped wall 113*c* provided between each wall 113*a* and 113*b*.

On one (the one, the whole of which has been illustrated in FIG. 8) holding wall 113*a*, there are formed a cutout 113*d* and an elastic rib 113*f*, which protrudes an engaging projection 113*e* for engaging the flange 97. Also, on the other holding wall 113*a*, at a position opposite to the cutout 113*d* of the one holding wall 113*a*, there are formed an elastic rib (not shown) having the same shape as the elastic rib 113*f*, and a cutout 113*d* opposite to the elastic rib 113*f* of the one holding wall 113*a*.

Between the housing walls 113*b*, there is formed a bottom wall 113*g*, and at the center of the bottom wall 113*g*, there is formed a holding hole 113*h* for holding the elastic strut 94 in a state penetrated by the pressing strut 95.

Therefore, the flange 97 is pressed in between the holding walls 113*a* so as to cause the pressing strut 95 to penetrate a holding hole 113*h*, whereby the elastic rib 113*f* returns to the original state after once deformed; by means of cooperation between the stepped wall 113*c* and the engaging projection 113*e*, the flange 97 is interposed therebetween; and the holding member 90 is held by the holder main body 100. In this respect, the holding member 90 can be removed only by drawing it out as occasion arises.

The fixed knob 105 has coaxially an inner tube 114. Within the inner tube 114, there is formed a holding tubular portion 115 consisting of a plurality of pawls 115*a*, the diameter of which is made variable by the rotation of the fixed knob 105. Also, within the holding tubular portion 115, there is protruded a rib 116 which extends in the longitudinal direction of the rectangular frame 101. In this respect, the range of rotation of the fixed knob 105 is regulated by a projection 117 provided on the fixed knob 105 abutting upon the inner wall of the knob portion 103.

Accordingly, in a state in which the diameter (inner diameter) of the holding tubular portion 115 is at the maximum, a cylindrical column-shaped portion 96 is inserted into the holding tubular portion 115; a positioning groove 96*a* is caused to engage the rib 116; from this state, the fixed knob 105 is rotated to change the diameter of the holding tubular portion 115 in a reducing direction, whereby the pawls 115*a* engage with an annular restraining groove 96*b* so that the cylindrical column-shaped portion 96 is fastened and held by the holder main body 100 in a falling-off stopped state.

As described above, the holder main body 100 holding the template 80 and the holding member 90 is, as shown in FIGS. 10(*a*) to 10(*c*), adapted to engage the holding pawls 43 and 43 when inserted between the frame guide members 48 and 48 in the order of FIGS. 10(*a*) to 10(*c*). Thus, at this position, the holding pawl 44 is inserted into the holder main body 100 through the insertion hole 108 in such a manner that the holder main body 100 is retained between the holding pawls 43 and 44 (clamping pins).

When the holder main body 100 is used, holding member detecting means (not shown) detects to input a detection signal to an arithmetic control circuit (not shown), the arithmetic control circuit (operating means) causes a template feeler in place of the feeler 50 to abut upon a template T for measuring the shape of the template T. For the structure of this template feeler, the same, well-known structure as Japanese Patent Application No. 8-320468 is adopted, and therefore, the detailed description will be omitted. In this respect, a template feeler of a type to rise and fall by the same, well-known manual operation as Japanese Patent Application No. 2-113840 can also be adopted instead of such automatic detection.

[Operation]

Next, the description will be made of an operation of a frame shape measuring apparatus 1 having such configuration.

(1) Measuring the Shape of the Lens Frame for a Glasses Frame

Inclined guide plate portions 48*c* and 48*c* for frame guide members 48 and 48 incline in a direction to open each other toward the top end. Therefore, when a glasses frame MF for a glasses is disposed between the inclined guide plate portions 48*c* and 48*c* as shown in FIG. 4(*a*) and the glasses frame MF is depressed from above against the spring force of a coil spring 40, the interval between the frame guide members 48 and 48, that is, the interval between movable frames (sliders) 37 and 37 is widened by the guide operation of the inclined guide plate portions 48*c* and 48*c*, a rim of the glasses frame MF, that is, the lens frame LF (RF) of the glasses frame MF is moved to above the holding pawl 43, 43 and is restrained by the holding pawl 43, 43.

In such a state, when the operating lever 27 is rotated from the "Open" position to the "Close" position, this rotation is transmitted to the tubular shaft 33 through the rotating shaft 25, the gears 26 and 24, and the operating shaft 23 so that a portion of the spring 35 is wound around the tubular shaft 33, whereby the pawl mounting plate 42 is rotated upwardly around one side portion 42*a* through wire 36 provided contiguously to the spring 35, the interval between the holding pawls 43 and 44 is narrowed as shown in FIG. 4(*c*), and the rim of the glasses frame MF, that is, the lens frame LF (RF) of the glasses frame MF is retained between the holding pawls 43 and 44 as shown in FIG. 4(*c*). At this position, a movable pin 31 is to be retained at the lower end portion 20*a* of the circular arc-shaped slit 20 by the spring force of the spring 32.

In this respect, when the rim of the glasses frame MF, that is, the lens frame LF (RF) of the glasses frame MF is removed from between the holding pawls 43 and 44, each member operates in the reverse direction by reversing the procedure of the operating lever 27.

(2) Measuring the Shape of the Template 80

In order to measure the shape of the template 80 by this lens shape measuring apparatus 1, the template 80 is first mounted to the holding member 90. In other words, first in a state, in which the elastic strut 94 of the holding member 90 does not elastically become deformed into the barrel shape, the pressing strut 95 is inserted into the holding hole 81 of the template 80, and the template 80 is brought into tight contact with the flange 97-side surface (template engaging portion) 91*b* in a state in which each projection 97*a*, 97*b* is engaged with each hole 82, 83. Thereafter, as shown in FIG. 6, the pressing strut 95 is rotated to thereby elastically deform the elastic strut 94 into the barrel shape. Thereby, the diameter of the elastic strut 94 becomes larger, the outer peripheral surface of the elastic strut 94 moves and makes a displacement to the inner peripheral edge side of the holding hole 81 of the template 80 to be urged against the holding hole 81, and the template 80 is mounted (is retained) to the holding member 90.

Thus, in a state in which the diameter (inner diameter) of the holding tubular portion 115 is at the maximum, the cylindrical column-shaped portion 96 of the holding member 90 is inserted into the holding tubular portion 115 and the positioning groove 96*a* of the cylindrical column-shaped portion 96 is engaged with the rib 116. Next, the fixed knob 105 is rotated from this state to thereby reduce the diameter of the holding tubular portion 115, whereby the pawl 115*a* is engaged with the annular restraining groove 96*b* so that the cylindrical column-shaped portion 96 is fastened and held by the holder main body 100 in a falling-off stopped state. Thus, the holding member 90 to which the template 80 has been mounted, is caused to be retained by the holder main body 100.

This holder main body 100 is positioned between the inclined guide plate portions 48*c* and 48*c* of the movable frames 37 and 37 as in FIG. 10A, and thereafter, is caused to abut upon the inclined guide plate portions 48*c* and 48*c* indicated by a dots-and-dash line of FIG. 10(*b*), and is pressed downwardly. Thereby, the holder main body 100 makes a displacement below guided by the inclined guide plate portions 48*c* and 48*c*, and at the same time, the movable frames 37 and 37 are caused to move and make a displacement in a direction to retract from each other against the spring force of the extension coil spring 40. Thus, as shown in FIG. 10(*c*), the holder main body 100 is inserted between the frame guide member 48 and 48 to be engaged with the holding pawls 43 and 43.

Thereafter, the operating lever 27 is rotated in the "Close" direction, this rotation is transmitted to the operating shaft 23, the driving gear 26, the driven gear 24 and the rotating shaft 25, and a spring 35 of a string-shaped body 34 is wound around the rotating shaft 35, whereby the pawl mounting plate 42 is caused to make a displacement upwardly through wire 36 of a string-shaped body 34. At this time, upward movement of the holding pawl 44 is regulated by the engaging pawl 46, the holding pawl 44 is rotated to the pawl mounting plate 42 side about the supporting shaft 45, the tip end portion is inserted into the holder main body 100 through the insertion hole 108, and the holder main body 100 is retained between the holding pawls 43 and 44 (clamping pins).

In this state, the feeler 50*a* of the frame shape measuring apparatus (lens shape measuring apparatus) 1 is caused to abut upon the peripheral surface of the template 80 as shown FIG. 10(*c*) to move the feeler 50*a* along the peripheral surface of the template 80, whereby a moving position of the feeler 50*a* is determined as a radius vector $\rho i$ to an angle $\theta i$, that is, as lens shape information ($\theta i$, $\rho i$) of polar coordinates type. For the measuring mechanism and measuring method using this feeler 50*a*, the detailed description will be omitted because those well-known disclosed in the previous application by the applicant of the present application can be adopted.

[Second Embodiment]

Figure 11A:
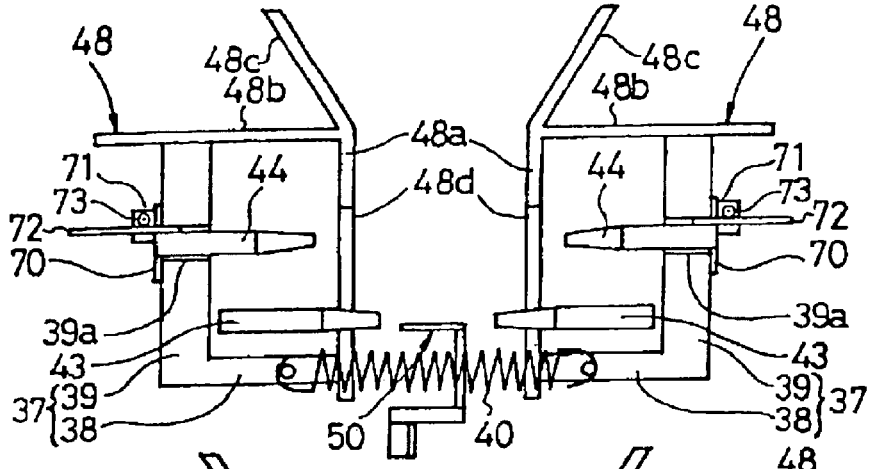
FIGS. 11(*a*) to 11(*c*) are operation explanatory views showing an example of a lens shape measuring apparatus according to the second embodiment of the present invention.
Figure 11B:
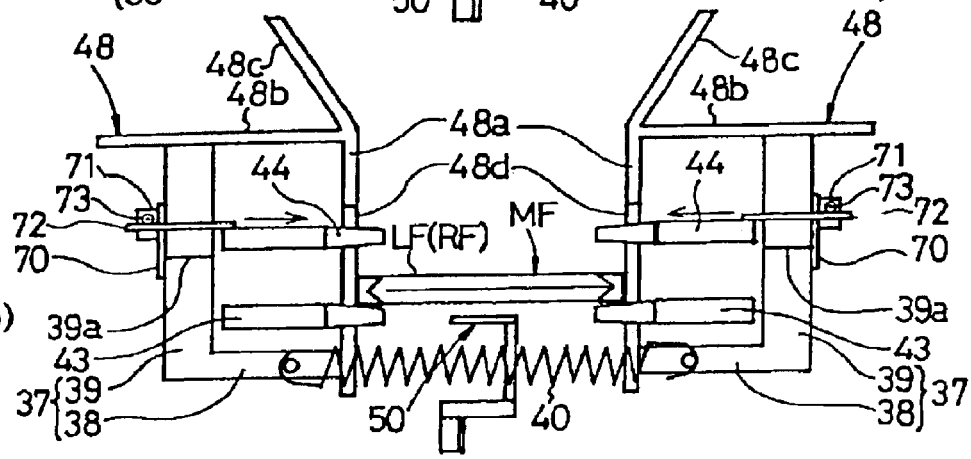
Figure 11C:
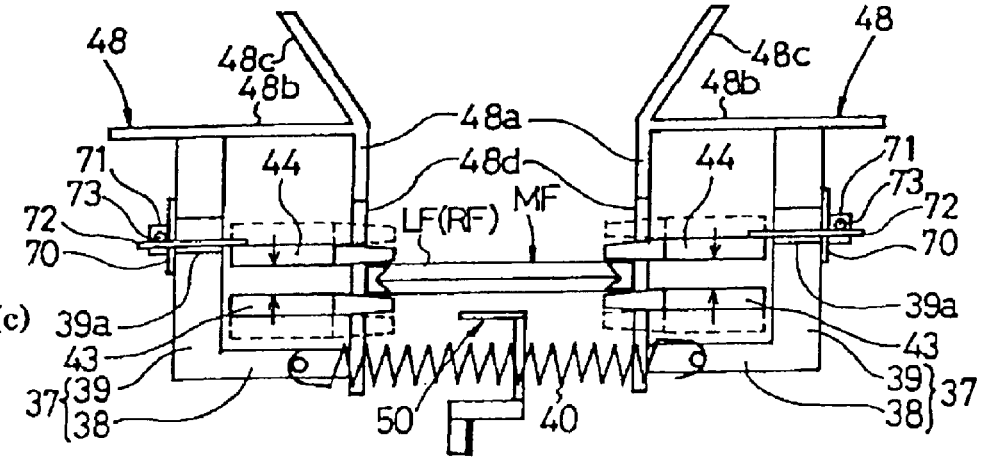

In this respect, the preset invention is not limited to the above-described embodiment, but the configuration may be arranged as shown in FIG. 11. In the embodiment shown in FIG. 11, the engaging pawl 46 having the configuration shown in FIGS. 1 to 4 is omitted, and the mounting structure of the holding pawl 44 is changed. Moreover, the present embodiment is the same as FIG. 1 in the other configuration.

In FIG. 11, the holding pawl 43 is held by the movable frame 37 in the same manner as in FIG. 1. Also, on the vertical plate portion 39 of the movable fame 37, there is provided a through hole 39*a*; on the back of the vertical plate portion 39, there is mounted a guide rail 70 which extends vertically; on this guide rail 70, there is held a slider 71 so as to be movable vertically; on the slider 71, a rack bar 72, inserted into the through hole 39*a*, is held so as to be movable in the lateral direction in FIG. 1; and the driving pinion 73 held by the slider 71 is meshed with the rack bar 72. At the end portion of the rack bar 72 on the aperture 48*d* side, the holding pawl 44 is fixed.

Moreover, the slider 71 is vertically moved by a driving motor (not shown), and the driving pinion 73 is adapted to be rotationally driven by a driving motor (not shown). The vertical movement of the slider 71 by this driving motor and rotary driving of the driving pinion 73 is adapted to be performed at the following timing.

In other words, in a state in which the operating lever 27 shown in FIG. 2 is at the "Open" position, as shown in FIG. 11(*a*), the proximal portion of the holding pawl 44 is positioned within through hole 39*a*, the tip end of the holding pawl 44 is positioned at a retracted position between the vertical plate portions 48*a* and 39, and does not protrude between the vertical plate portions 48*a* and 48*a*.

In this state, when a glasses frame MF for glasses is disposed between the inclined guide plate portions 48*c* and 48*c* as shown in FIG. 4(*a*) and the glasses frame MF is depressed from above against the spring force of a coil spring 40, the interval between the frame guide members 48 and 48, that is, the interval between movable frames (sliders) 37 and 37 is widened by the guide operation of the inclined guide plate portions 48*c* and 48*c*, a rim of the glasses frame MF, that is, the lens frame LF (RF) of the glasses frame MF is moved to above the holding pawl 43, 43 and is restrained by the holding pawl 43, 43.

Next when the operating lever 27 shown in FIG. 2 is rotated from the "Open" position to the "Close" position, the switch (not shown) is turned ON at the beginning of the rotation by the operating lever 27; the driving pinion 73 is rotationally driven by the driving motor; the rack bar 72 and the holding pawl 44 are moved to the aperture 48*d* side of the vertical plate portion 48*a* as indicated by an arrow; the tip end portion of the holding pawl 44 is caused to protrude from the aperture 48*d* as shown in FIG. 11(*b*); and the proximal portion of the holding pawl 44 falls off from the through hole 39*a*. Thereafter, the slider 71 is moved downwardly by a driving motor (not shown) so that the holding pawl 44 is lowered from a position indicated by a broken line to a position indicated by a solid line as shown in FIG. 11(*c*).

On the other hand, when the operating lever 27 is rotated to the "Close" position side as described above, this rotation is transmitted to the tubular shaft 33 through the rotating shaft 25, the gears 26 and 24, and the operating shaft 23 and a portion of the spring 35 is wound around the tubular shaft 33, whereby the pawl mounting plate 42 is rotated upwardly about one side portion 42*a* through wire 36 provided contiguously to the spring 35; the holding pawl 43 is raised from a position indicated by a broken line to a position indicated by a solid line as shown in FIG. 11(*c*) to narrow the interval between the holding pawls 43 and 44; and the rim of the glasses frame MF, that is, the lens frame LF (RF) of the glasses frame MF is held between the holding pawls 43 and 44. At this position, the movable pin 31 is held at the lower end portion 20*a* of the circular arc-shaped slit 20 by the spring force of the spring 32.

In this respect, when the rim of the glasses frame MF, that is, the lens frame LF (RF) of the glasses frame MF is removed from between the holding pawls 43 and 44, the procedure of the operating lever 27 is reversed to thereby activate a second switch (not shown), which turns ON by the rotating operation of the operating lever 27 so that each member operates in the reverse direction.

In the present embodiment, the lateral movement (frequent appearance from the aperture 48*d*) of holding pawl 44 by the driving motor and vertical movement of the holding pawl 44 has been performed, but his operation may be performed by means of a solenoid, or a similar operation to that shown in FIG. 11 can be also performed by interlocking the operating lever 27 through the use of wire or a gear driving mechanism. Also, in the above-described embodiment, since it is not an essential portion of the present invention, for the sake of convenience in explaining, the description has been made of the structure in which the movable frames 37 and 37 are biased in a direction to directly approach by the coil spring 40. Actually, however, when one of the movable frames 37 and 37 is caused to advance toward or retreat from the central position, the movable frames 37 and 37 are set so as to interlock in a mechanism using wire, a pulley or the like, or in a mechanism using a gear or the like in such a manner that the other movable frame 37 interlocks with one movable frame 37 to advance toward or retreat from the central position and the movable frames 37 and 37 move in the direction toward and away from each other.

[Third Embodiment]

FIGS. 12 to 16 show the third embodiment according to the present invention, showing a holding member (template mounting member) 90*a*, which the holding tubular portion 115 of the holder main body 100 is caused to hold. The holding member 90*a* as this template mounting means has a base portion 91 made of resin, which the holder body 100 is caused to hold.

Figure 12:
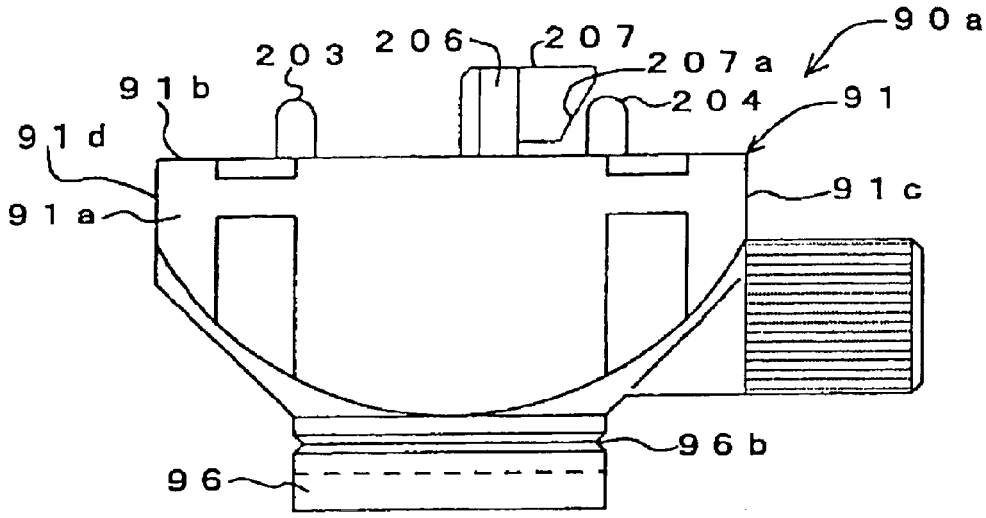
FIG. 12 is a side view showing a holding member of the template holder according to the third embodiment of the present invention.

This base portion 91 has, as shown in FIG. 12, a main body 91*a* of base, the lower portion side of which has been formed in taper shape toward the lower side, and a cylindrical column-shaped portion 96 integrally provided at a tapered end portion (lower portion of FIG. 12) of the main body 91*a* of base.

Figure 13:
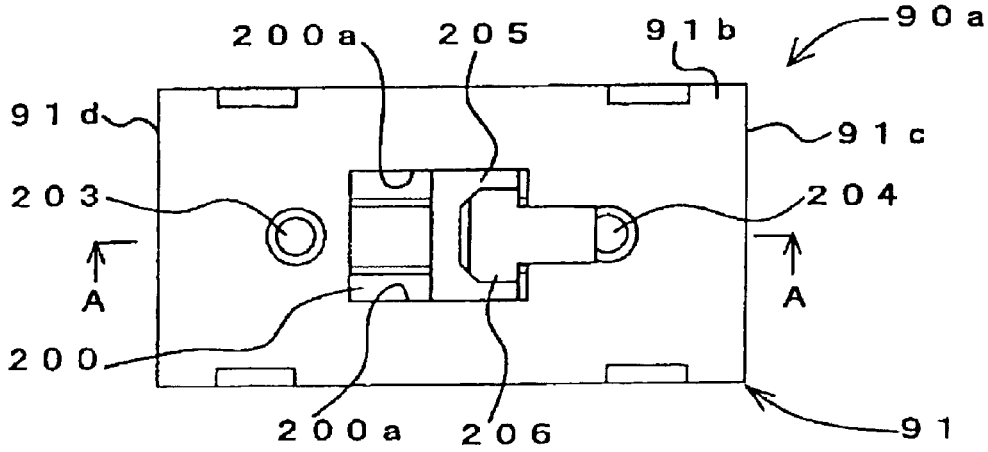
FIG. 13 is a plan view of FIG. 12.
Figure 14:
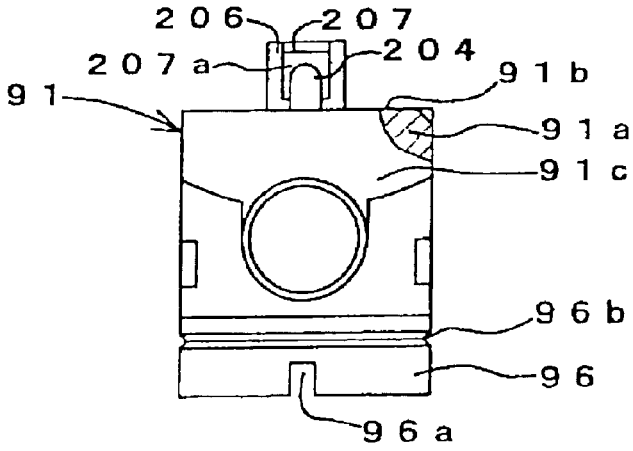
FIG. 14 is a right side view of FIG. 12.

Also, an upper end surface 91*b* of the main body 91*a* of base in FIG. 12 has, as shown in FIG. 13, a plane formed in a rectangular shape. A reference symbol 91*c* or 91*d* denotes an end surface of the main body 91*a* of base in the longitudinal direction. Moreover, the main body 91*a* of base has a rectangular parallelepiped-shaped guide hole 200, which is opened at the center of the end surface 91*b*, a shaft inserting hole 201, which is opened at the end surface 91*c* and the guide hole 200, and a shaft inserting hole 202, which is provided coaxially with the shaft inserting hole 201 and is opened on the end surface 91*d* and the guide hole 200. The plane of the guide hole 200 is formed in the shape of a rectangle, which is long and narrow from side to side as shown in FIG. 13. Also, the shaft inserting hole 202 has a small-diameter hole portion 202*a* having the same diameter as the shaft inserting hole 201, and a hole portion 202*b* having a larger diameter than the small-diameter hole portion 202*a*, and between the hold portion 202*a* and the hole portion 202*b*, there is formed a stepped surface 202*c*.

Moreover, on an end surface of the cylindrical column-shaped portion 96, there is formed a positioning groove 96*a*, which extends in the same direction as the longitudinal direction of the main body 91*a* of base. Also, on the outer periphery of the cylindrical column-shaped portion 96, there is formed an annular restraining groove 96*b* having a V-shaped cross section.

Figure 15:
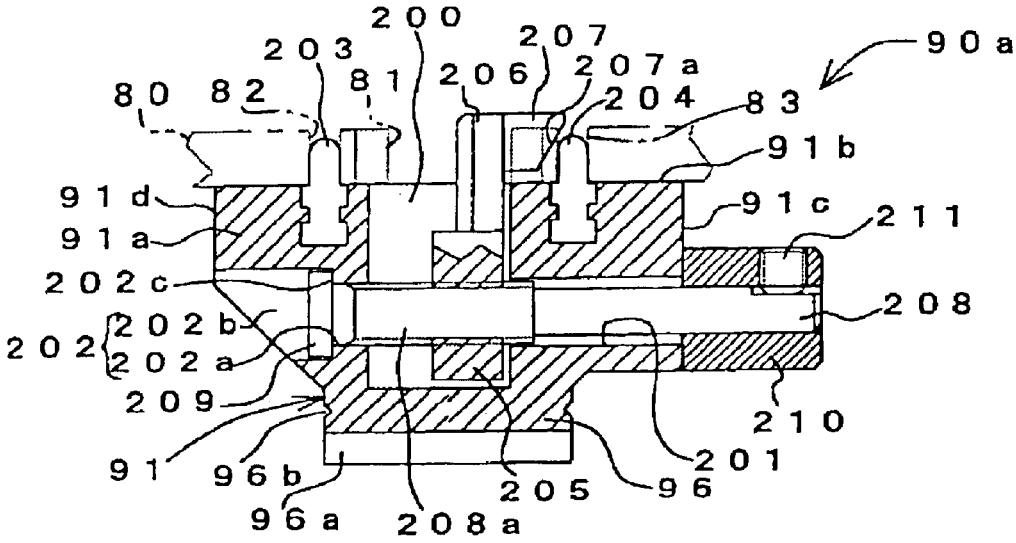
FIG. 15 is a cross-sectional view taken on line A—A of FIG. 13.

Further, on the main body 91*a* of base, proximal portions of engaging pins 203 and 204 for protruding from the end surface 91*b* are buried and fixed as shown in FIG. 15.

Also, within the guide hole 200, there is disposed a rectangular plate-shaped sliding member (movement restraining member) 205 as a template restraining member so as to be able to advance and retreat along sides 200*a* and

200*a* of the guide hole 200 in the right-and-left directions. In this respect, the rotation of the sliding member 205 is regulated by the sides 200*a* and 200*a* of the guide hole 200. Moreover, the sliding member 205 integrally has an arm portion 206 protruding from the end surface 91*b*. This arm portion 206 causes the template 80 to abut upon the end surface (template engaging portion) 91*b*, and in a state in which engaging pins 203 and 204 have been inserted into holes 82 and 83 of the template 80, the arm portion 206 of the sliding member (template restraining member) 205 is adapted to be able to advance toward and retreat from the inner peripheral edge of holding hole 81 of the template 80.

Further, at a protruding end portion from the guide hole 200 of this arm portion 206, there is integrally formed an engaging protruded portion (template engaging portion) 207 protruding on the engaging pin 204 side in a moving direction of the sliding member 205. On this engaging protruded portion 207, there is formed an engaging surface 207*a*, as a pressing surface (pressing portion), which inclines so as to face the engaging pin 204 from the tip end side.

Also, in the shaft inserting hole 201, 202, an intermediate portion and one end portion of the tapped shaft (operating shaft, that is, operating member) 208 penetrating the guide hole 200 and the sliding member 205 are inserted. At one end portion of this tapped shaft 208, there is integrally formed a circular flange (large-diameter regulating portion) 209 as a head. This flange 209 is fitted and disposed within the large-diameter hole portion 20*b*, and is abutted upon a stepped surface (movement regulating stepped surface) 202*c*.

In a portion facing the guide hole 200 of the threaded shaft 208, there is formed a threaded portion 208*a*. This threaded portion 208*a* is threadably attached to a penetrating portion in the sliding member 205. Thus, the axis of the threaded shaft 208 is directed in the advance and retreat direction of the arm portion 206. Further, at the protruded end portion from the end surface 91*c* of the threaded shaft 208, the operating knob 210 is fixed by screws 211. Moreover, this operating knob 21 is abutted upon the end surface 91*c*, and the movement of the threaded shaft 208 in the axial direction is regulated together with the flange 209.

Next, the description will be made of an operation of the holding member 90*a* having such configuration.

In such configuration, in order to mount the template 80 to the holding member 90*a*, the sliding member 205 is first positioned at the substantially center in a moving direction of the guide hole 200 in FIG. 15 to cause the engaging protruded portion 207 to face the guide hole 200. Next, in this state, while the tip end portion of the arm portion 206 and the engaging protruded portion 207 are inserted into the holding hole 81 of the template 80, the template 80 is caused to abut upon the end surface (template engaging portion) 91*b*, and engaging pins 203 and 204 are inserted into holes 82 and 83 in the template 80.

Thus, the operating knob 210 is taken with fingers to rotate the threaded shaft 208 in the forward direction, whereby the sliding member 205 is moved to the operating knob 210 side by the operation of the threaded portion 208*a* to thereby move the arm portion 206 and the engaging protruded portion 207 to the inner peripheral edge side of the holding hole 81 of the template 80 so that an engaging surface 207*a* of the engaging protruded portion 207 presses the template 80 against the end surface 91*b*. Thereby, the template 80 will be interposed between the end surface 91*b* and the engaging surface 207*a*.

In the holding member 90*a*, to which the template 80 has been mounted as described above, the cylindrical column-shaped portion 96 is caused to be held by the holding tubular portion 115 of the holder main body 100 in the same manner as in the first embodiment of the present invention. Thus, this holder main body 10 is mounted to the lens frame shape measuring apparatus 1 to measure the shape of the template 80 by means of the lens frame shape measuring apparatus 1 in the same manner as described above. In this respect, in order to remove the template 80, the above-described mounting operation will be reversed.

[Fourth Embodiment]

FIGS. 16 to 19 show the fourth embodiment according to the present invention, showing a holding member (template mounting member) 90*a*, which the holding tubular portion 115 of the holder main body 100 is caused to hold. The holding member 93*a* as this template mounting means has a base portion 91 made of resin, which the holder main body 100 is caused to hold.

Figure 16:
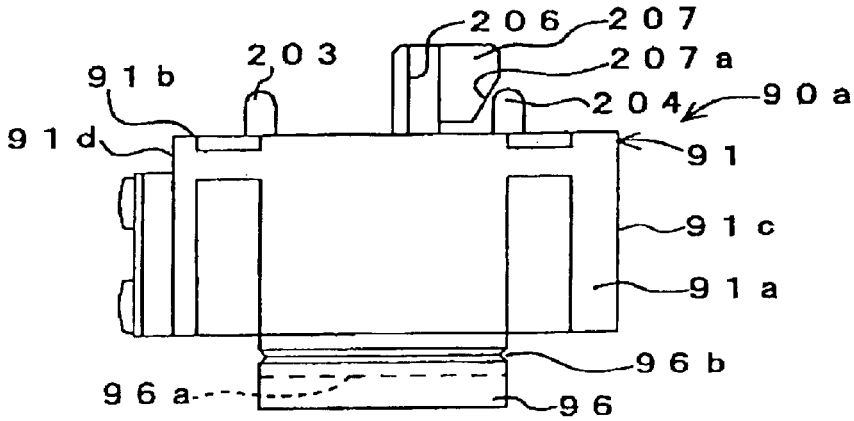
FIG. 16 is a side view showing a holding member of the template holder according to the fourth embodiment of the present invention.
Figure 17:
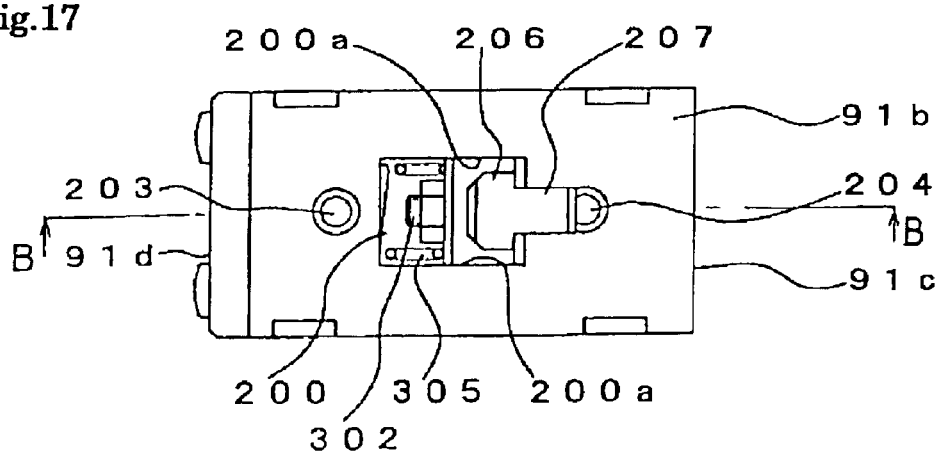
FIG. 17 is a plan view of FIG. 16.
Figure 18:
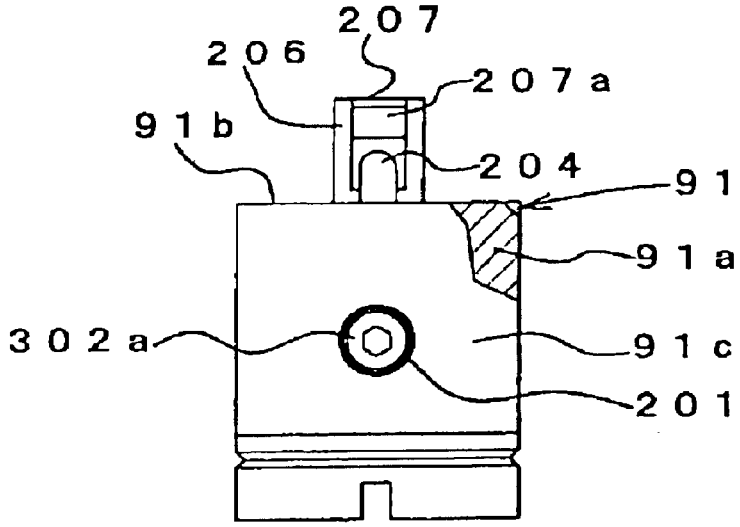
FIG. 18 is a right side view of FIG. 16.

This base portion 91 has, as shown in FIG. 16, a main body 91*a* of base, which extends in a rectangular parallelepiped shape from side to side, and a cylindrical column-shaped portion 96 integrally provided at the central lower part in the right-and-left directions of the main body 91*a* of base.

Also, an upper end surface 91*b* of the main body 91*a* of base in FIG. 12 has, as shown in FIG. 13, a plane formed in a rectangular shape. A reference symbol 91*c* or 91*d* denotes an end surface of the main body 91*a* of base in the longitudinal direction.

Figure 19:
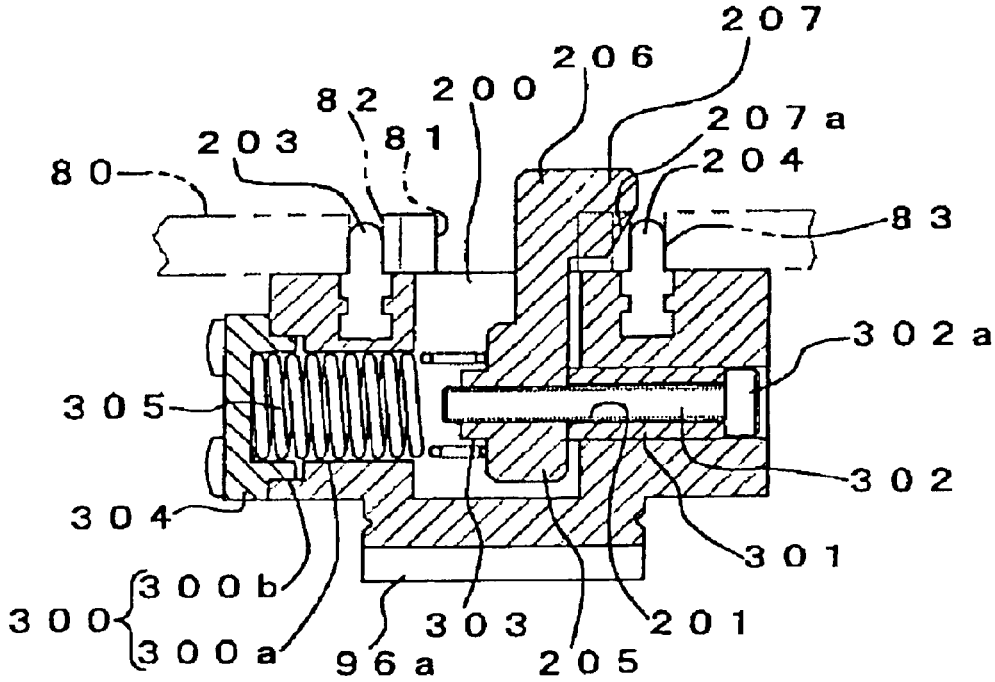
FIG. 19 is a cross-sectional view taken on line B—B of FIG. 17.

Moreover, the main body 91*a* of base has a rectangular parallelepiped-shaped guide hole 200, which is opened at the center of the end surface 91*b*, a shaft inserting hole 201, which is opened at the end surface 91*c* and the guide hole 200, and a spring disposed hole (holding hole) 300, which is provided coaxially with the shaft inserting hole 201 and is opened at end surface 91*d* and the guide hole 200. The plane of the guide hole 200 is formed in the shape of a rectangle, which is long and narrow from side to side as shown in FIG. 13. Also, the spring disposed hole 300 has, as shown in FIG. 19, a small-diameter hole portion 300*a* which is opened at the guide hole 200, and a large-diameter portion 300*b* on the end surface 91*d* side.

Moreover, on an end surface of the cylindrical column-shaped portion 96, there is formed a positioning groove 96*a*, which extends in the same direction as the longitudinal direction of the main body 91*a* of base. Also, on the outer periphery of the cylindrical column-shaped portion 96, there is formed an annular restraining groove 96*b* having a V-shaped cross section.

Further, on the main body 91*a* of base, proximal portions of engaging pins 203 and 204 for protruding from the end surface 91*b* are buried and fixed as shown in FIG. 15.

Also, within the guide hole 200, there is disposed a rectangular plate-shaped sliding member (movement restraining member) 205 as a template restraining member so as to be able to advance and retreat along sides 200*a* and 200*a* of the guide hole 200 in the right-and-left directions. In this respect, the rotation of the sliding member 205 is regulated by the sides 200*a* and 200*a* of the guide hole 200. Moreover, the sliding member 205 integrally has an arm portion 206 protruding from the end surface 91*b*. This arm portion 206 causes the template 80 to abut upon the end surface (template engaging portion) 91*b*, and in a state in which engaging pins 203 and 204 have been inserted into holes 82 and 83 of the template 80, the arm portion 206 of the sliding member (template restraining member) 205 is adapted to be able to advance toward and retreat from the inner peripheral edge of holding hole 81 of the template 80.

Further, at a protruding end portion from the guide hole 200 of this arm portion 206, there is integrally formed an engaging protruded portion (template engaging portion) 207 protruding on the engaging pin 204 side in a moving direction of the sliding member 205. On this engaging protruded portion 207, there is formed an engaging surface 207*a*, as a pressing surface (pressing portion), which inclines so as to face the engaging pin 204 from the tip end side.

Also, in the shaft inserting hole 201, a tubular sliding shaft 301, the outer surface of which has been smoothly formed by bearing material, is fitted so as to be able to advance and retreat in the axial direction. This sliding shaft 301 is fixed to the sliding member 205 by means of a screw (operating member) 302 which has been inserted into the sliding shaft 301. Also, at this sliding member 205, there is formed a protruded portion 303 protruding on the spring disposed hole 300 side, and to a large-diameter hole portion 300*b* of the spring disposed hole 300, there is threadably attached a spring bearing 304. Between the sliding member 205 and the spring bearing 304, there is interposed a coil spring 305. In the coil spring 305, an end portion on the sliding member 205 side is formed in a taper shape, and the small-diameter side is fitted in the protruded portion 303. In this respect, the axes of the sliding shaft 301 and the screw 302 are directed in the advance and retreat direction of the sliding member 205 and the arm portion 206.

Next, the description will be made of operation of the holding member 90*a* having such configuration.

In such configuration, in order to mount the template 80 to the holding member 90*a*, the head 302*a* of the screw 302 is pressed toward the left against the spring force of the coil spring 305 in FIG. 19 to thereby cause the screw 302 and the sliding shaft 301 to make a displacement toward the left in FIG. 19. At this time, the engaging projection 207 can be pressed inside of the holding hole (through hole) 81 of the template 80.

On pressing such a head 302*a*, the sliding member 205 is positioned at the substantially center in a moving direction of the guide hole 200 in FIG. 19, and the engaging protruded portion 207 is caused to face the guide hole 200. Next, while, in this state, the tip end portion of the arm portion 206 and the engaging protruded portion 207 are inserted into the holding hole 81 of the template 80, the template 80 is caused to abut upon the end surface (template engaging portion) 91*b*, and engaging pins 203 and 204 are inserted into the hole 82 and 83 of the template 80.

Thereafter, when the pressing force onto the head 302*a* is released, the sliding member 205 is caused to move and make a displacement to the right in FIG. 19 by the spring force of the coil spring 305. At this time, the arm portion 206 and the engaging protruded portion 207 move to the inner peripheral edge side of the holding hole 81 of the template 80 so that the engaging surface 207*a* of the engaging protruded portion 207 presses the template 80 against the end surface 91*b*. Thereby, the template 80 will be interposed between the end surface 91*b* and the engaging surface 207*a*.

In the holding member 90*a*, to which the template 80 has been mounted as described above, the cylindrical column-shaped portion 96 is caused to be held by the holding tubular portion 115 of the holder main body 100 in the same manner as in the first embodiment of the present invention. Thus, this holder main body 10 is mounted to the lens frame shape measuring apparatus 1 to measure the shape of the template 80 by means of the lens frame shape measuring apparatus 1 in the same manner as described above. In this respect, in order to remove the template 80, the above-described mounting operation will be reversed.

[Fifth Embodiment]

Figure 20:
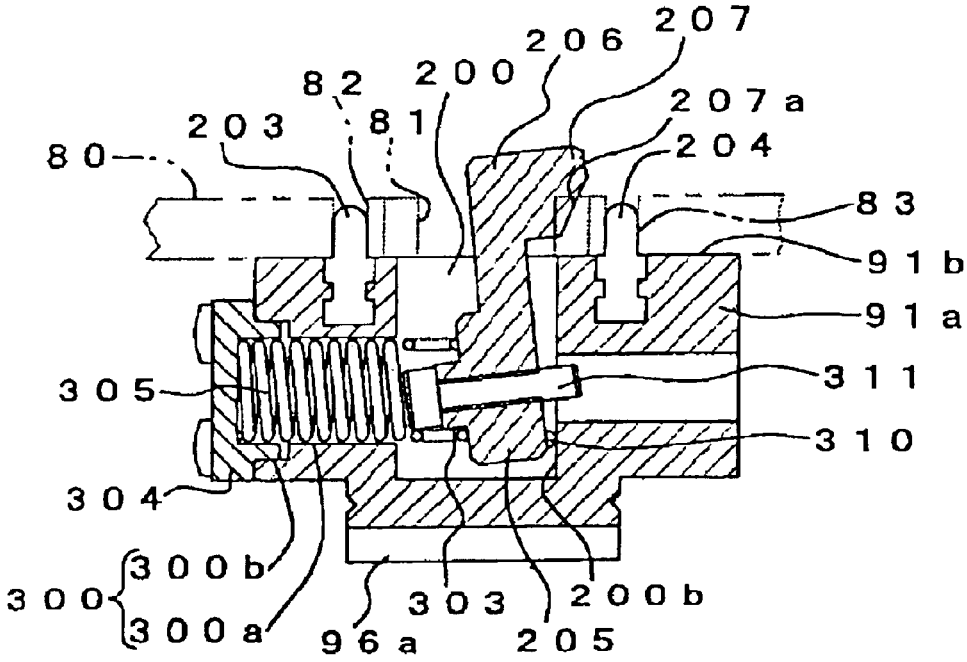
FIG. 20 is a cross-sectional view showing a holding member of the template holder according to the fourth embodiment of the present invention.
Figure 21:
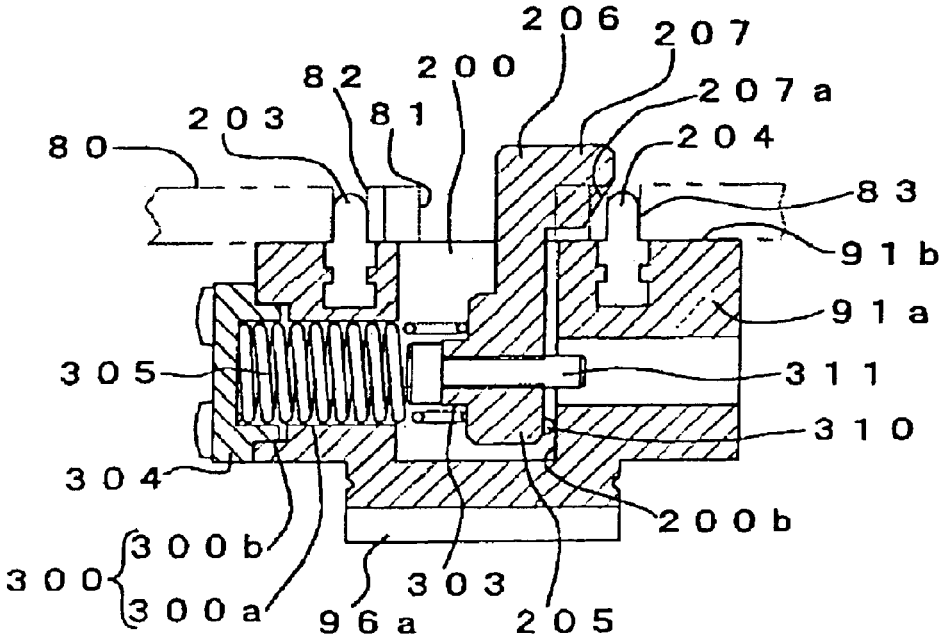
FIG. 21 is an operation explanatory view illuminating the holding member of FIG. 20.

FIGS. 20 and 21 show the fifth embodiment according to the present invention. The fifth embodiment according to the present invention is that the sliding shaft 301 and the screw 302 according to the fourth embodiment of the present invention are omitted and a semi-spherical projection 310 is provided at the lower end portion of the sliding member 205. This projection 310 is projectingly provided on the side 205*a* of the sliding member 205 on the shaft inserting hole 201 side, and abuts upon the inner wall surface 200*b* of the guide hole 200 on the shaft inserting hole 201 side. Also, to the sliding member 205, there is threadably attached a screw 311 for preventing the sliding member 205 from falling off from the guide hole 200. This screw 311 protrudes from the side 205*a* into the shaft inserting hole 201.

In this configuration, a protruded end portion of the arm portion 206 is taken with fingers to be pulled in a direction to go away from the engaging pin 204, whereby the arm portion 206 is rotated around the projection 310 against the spring force of the coil spring 305 as shown in FIG. 20 so that an engaging protruded portion 207 departs from the engaging pin 204. While, in this state, a tip end portion of the arm portion 206 and the engaging protruded portion 207 are inserted into the holding hole 81 of the template 80, the template 80 is caused to abut upon the end surface (template engaging portion) 91*b*, and the engaging pins 203 and 204 are caused to be inserted into the holes 82 and 83 of the template 80 respectively.

Thus, the arm portion 206 is caused to move to the engaging pin 204 side to engage an engaging surface 207*a* of the engaging protruded portion 207 with the inner peripheral edge of the holding hole 81 of the template 80 for moving the hands off the arm portion 206. In this state, the engaging member 207 is urged against the template 80 by the spring force of the coil spring 305 as shown in FIG. 21 to cause the template 80 to be held by the end surface 91*b* of the main body 91*a* of base. In the case of this embodiment, the template 80 can be attached to and detached from the main body 91*a* of base only by operating the arm portion 206 easily and quickly.

In the holding member 90*a*, to which the template 80 has been mounted as described above, the cylindrical column-shaped portion 96 is caused to be held by the holding tubular portion 115 of the holder main body 100 in the same manner as in the first embodiment of the present invention. Thus, this holder main body 10 is mounted to the lens frame shape measuring apparatus 1 to measure the shape of the template 80 by means of the lens frame shape measuring apparatus 1 in the same manner as described above. In this respect, in order to remove the template 80, the above-described mounting operation will be reversed.

As described above, according to the first aspect of the invention, there is provided a template holder comprising: a template mounting member, provided with a holding hole, and provided with a template engaging portion which engages a template formed in the lens shape of a glasses lens for abutting; a holder main body, by which the template mounting member is detachably held, and which is detachably mounted to the lens shape measuring apparatus; a template restraining member, which is movably held by the template mounting member, and which is inserted into the holding hole; and an operating member for moving and operating the template restraining member, in which the template is held by means of the template restraining member by operating the operating member, wherein the operating member and the template restraining member are held by the template mounting member when the template is attached and detached. Therefore, there is no possibility that parts such as screws for mounting the template to the template mounting member will be lost.

Also, according to the second aspect of the invention, in the template holder according to the first aspect, the template restraining member is an elastic strut to be inserted into the holding hole of the template, and the operating member is a pressing strut which causes the elastic strut to abut upon the holding hole under pressure by pressing the elastic strut to enlarge a diameter thereof for thereby moving an outer peripheral surface of the elastic strut to an inner peripheral surface side of the holding hole. Therefore, it is possible to easily perform an operation for attaching the template to and detaching from the template mounting member, and to reliably fix the template to the template mounting member irrespective of dimensional variations or the like of the holding hole.

According to the third aspect of the invention, in the template holder according to the second aspect, the pressing strut has a threaded shaft, which penetrates the elastic strut in the axial direction and which is threadably attached to the template mounting member in such a manner as to be freely back-and-forth movable within a predetermined range in the axial direction, and an operating knob provided at a protruded end portion of the threaded shaft and caused to abut upon the elastic strut. Therefore, it is possible to prevent parts such as the threaded shaft and the operating knob for compressing the elastic strut from being lost.

According to the fourth aspect of the invention, in the template holder according to the first aspect, the template restraining member is a mobile restraining member mounted to the template mounting member in such a manner as to be able to advance toward or retreat from the inner peripheral edge of the holding hole of the template, which is caused to abut upon the template engaging portion, the operating member is a threaded shaft which is held by the template mounting member in such a manner as to be freely rotatable and unmovable in the axial direction, and the threaded shaft has an axis directed toward the advance or retreat direction of the mobile restraining member, and is threadably attached to the mobile restraining member. Therefore, it is possible to prevent the mobile restraining member, and parts such as the threaded shaft for operating the mobile restraining member from being lost, and to facilitate an operation for attaching the template to or detaching from the template mounting member.

According to the fifth aspect of the invention, in the template holder according to the first aspect, the template restraining member is a mobile restraining member mounted to the template mounting member in such a manner as to be able to advance toward or retreat from the inner peripheral edge of the holding hole of the template, which has been caused to abut upon the template engaging portion, and the operating member is held by the template mounting member in such a manner as to be able to freely advance or retreat within a predetermined range in the advance or retreat direction of the mobile restraining member, and is spring-biased toward the inner peripheral edge of the template by a spring. Therefore, it is possible to prevent the mobile restraining member, and parts such as the operating member for operating the mobile restraining member from being lost, and to facilitate an operation for attaching the template to or detaching from the template mounting member.

Also, according to the sixth aspect of the invention, in the template holder according to any of the first to fifth aspects, the holder main body integrally has a housing portion for housing the template mounting member. Therefore, the template mounting member for mounting the template is stored together with the holder main body, whereby it is possible to prevent this template mounting member from being lost.

What is claimed is:

1. A template holder comprising:

a template mounting member, provided with a template engaging portion which engages a template formed in a lens shape of a glasses lens for abutting, said template provided with a holding hole;

a holder main body, by which said template mounting member is detachably held, and which is detachably mounted to a lens shape measuring apparatus; and a template restraining member, which is movably held by said template mounting member, wherein said template restraining member is a mobile restraining member mounted to said template mounting member in such a manner as to be able to advance toward or retreat from an inner peripheral edge of the holding hole of said template, which is caused to abut upon said template engaging portion, said template restraining member being movable between a held position for engaging said template and a released position for disengaging said template, and is spring-biased toward the inner peripheral edge of said template by a spring, and wherein said template restraining member is held by said template mounting member when said template is attached and detached.

2. The template holder according to claim 1, wherein said template restraining member has an engaging protruded portion for engaging and pressing the inner peripheral edge of the holding hole of said template against said template engaging portion.

3. The template holder according to claim 1, wherein said holder main body integrally has a housing portion for housing said template mounting member.

4. The template holder according to claim 2, wherein said holder main body integrally has a housing portion for housing said template mounting member.

* * * * *